US008979630B2

(12) United States Patent
Witty et al.

(10) Patent No.: US 8,979,630 B2
(45) Date of Patent: Mar. 17, 2015

(54) ROULETTE PERFORMANCE AND ANALYSIS

(75) Inventors: Simon McLaren Witty, Mosman (AU); Harley David Jackson, Collaroy Plateau (AU)

(73) Assignee: TCS John Huxley Australia Pty Limited, Artarmon New South Wales (AU)

( * ) Notice: Subject to any disclaimer, the term of this patent is extended or adjusted under 35 U.S.C. 154(b) by 48 days.

(21) Appl. No.: 13/510,478

(22) PCT Filed: Nov. 16, 2010

(86) PCT No.: PCT/AU2010/001539

§ 371 (c)(1),
(2), (4) Date: May 17, 2012

(87) PCT Pub. No.: WO2011/060486

PCT Pub. Date: May 26, 2011

(65) Prior Publication Data

US 2012/0231866 A1 Sep. 13, 2012

(30) Foreign Application Priority Data

Nov. 17, 2009 (AU) ..... 2009905614
Nov. 12, 2010 (AU) ..... 2010905020

(51) Int. Cl.
*A63F 5/00* (2006.01)
*G07F 11/32* (2006.01)
*G07F 17/32* (2006.01)

(52) U.S. Cl.
CPC ..... *G07F 11/32* (2013.01); *G07F 17/3234* (2013.01); *G07F 17/322* (2013.01)
USPC ..... 463/17

(58) Field of Classification Search
CPC ... G06F 17/32; G06F 17/3206; G06F 17/322; G06F 17/323; G06F 17/3232; G06F 17/3234; G06F 17/3241; G06F 17/3244; G06F 17/3269; G06F 17/3272
USPC ..... 273/108, 118 R, 123 R, 118 D, 127 R, 273/127 B, 269, 270, 271, 274, 275, 283, 273/139, 144 R, 144 A, 144 B, 293, 108.51, 273/108.52, 108.53, 108.54, 109, 119 B, 273/119 R, 120 R, 129 M, 129 S, 141 R, 273/142 G, 142 R, 138, 138.1, 143 R, 143 B, 273/143 E, 142 A, 142 B, 142 C, 142 D, 142 E, 273/142 F, 142 H; 463/1, 16, 17, 18, 19, 22, 463/25, 39–43, 2, 10, 20, 21
See application file for complete search history.

(56) References Cited

U.S. PATENT DOCUMENTS

| | | | | |
|---|---|---|---|---|
| 5,755,618 | A | 5/1998 | Mothwurf | |
| 6,283,856 | B1 | 9/2001 | Mothwurf | |
| 6,733,388 | B2 * | 5/2004 | Mothwurf | 463/17 |
| 2002/0072405 | A1 | 6/2002 | Soltys | |
| 2006/0068878 | A1 | 3/2006 | Krenn | |
| 2007/0010310 | A1 | 1/2007 | Goossens | |
| 2008/0076529 | A1 * | 3/2008 | Richards et al. | 463/25 |

FOREIGN PATENT DOCUMENTS

| | | |
|---|---|---|
| GB | 2227946 | 8/1990 |
| WO | WO0151142 | 7/2001 |

OTHER PUBLICATIONS

International Search Report issued in PCT/AU2010/001539 and mailed on Feb. 9, 2011.
International Search Report issued in PCT/AU2010/001539.
Search and Examination Report Under Sections 17 and 18(3) issued in GB Application No. GB1210538.3 dated Aug. 22, 2013.

* cited by examiner

*Primary Examiner* — Damon Pierce
*Assistant Examiner* — Jeffrey Wong
(74) *Attorney, Agent, or Firm* — Parsons Behle & Latimer

(57) ABSTRACT

A method and system for monitoring consecutive games of roulette played at a live roulette gaming table. The table includes a table layout, a roulette wheel and a chipper machine for sorting and counting betting chips. During each game, players bet on a spin of the roulette wheel by indicating bets on the table layout with the chips. Chip count data from the chipper machine along with game activity data from one or more gaming table monitoring systems is recorded and processed by a table computer to identify at least one game delineation event and associated timing information. The chip count data is analyzed based on the timing information for game delineation event: and then portions of the chip count data are assigned to respective roulette games. The recorded data may be later analyzed to determine a range of performance characteristics including optimization characteristics, and/or immediately communicated to the table operators.

17 Claims, 11 Drawing Sheets

ROULETTE PERFORMANCE AND ANALYSIS

CROSS-REFERENCE TO RELATED APPLICATIONS

This application claims priority under 35 U.S.C. §119(e) from International Application No. PCT/AU2010/001539, filed Nov. 16, 2010, entitled "Roulette Performance and Analysis" which claims priority from Australian Patent Application No. 2010905020 filed Nov. 12, 2010 and Australian Patent Application No. 2009905614 filed Nov. 17, 2009 the entire contents are hereby incorporated by reference in their entirety.

FIELD OF THE INVENTION

The present invention relates generally to the game of roulette and more particularly to the analysis and performance of roulette tables.

BACKGROUND OF THE INVENTION

The following discussion of the prior art is intended to facilitate an understanding of the invention and to enable the advantages of it to be more fully understood. It should be appreciated, however, that any reference to prior art throughout the specification should not be construed as an express or implied admission that such prior art is widely known or forms part of common general knowledge in the field.

Casinos currently rely on data that is collected and analysed manually in order to determine the parameters of roulette tables. The information collected is very general, incomplete, non-specific, averaged over long periods of time, and is processed in a non-analytical manner subject to hunches and guesswork.

U.S. Pat. No. 6,283,856 seeks to identify individual player bets by allocating a chip to a patron and then interpreting the data from a chip sorting machine for the purpose of individual analysis of that patron. Some measures for monitoring the players activities and croupiers performance are discussed but the document discloses no method for optimising game performance. Moreover, the document is limited to monitoring individual tables.

It is an object of the present invention to overcome or substantially ameliorate one or more of the deficiencies of the prior art, or at least to provide a useful alternative.

SUMMARY OF THE INVENTION

Accordingly the invention provides a computer implemented method for monitoring a live roulette table, the method including:

receiving data from one or more roulette table components comprising receiving betting chip count data from a chipper machine that counts physical betting chips utilised at the roulette table;

storing the chip count data with associated timing information;

processing the data received from the one or more roulette table components, thereby to identity game delineation events and timing information for each of identified the game delineation events; and analysing the chip count data based on the timing information for the identified game delineation events, thereby to associate portions of the stored chip count data with respective roulette games.

Preferably, the table components include:

a table layout;

a roulette wheel; and a chipper machine for sorting and counting betting chips;

whereby each game, players bet on a spin of the roulette wheel by indicating bets on the table layout with the chips.

Preferably, the method includes allocating each player a plurality of a unique type of betting chip, and wherein the chip count data includes the number of each type of chips counted by the chipper machine.

Preferably, the one or more roulette table components include one or more monitoring systems configured to monitor activity at the roulette table.

Preferably, one of the monitoring systems provides a signal indicative of activity at a physical roulette wheel of the table.

Preferably, one of the monitoring systems provides a signal indicative responsive to predefined actions of a table operator.

Preferably each game includes:

a betting phase where players indicate their bets on the table layout;

a spin phase, where a roulette ball is spun in the roulette wheel to randomly select winning bets;

a payout phase where any winning bets made by the players are identified and paid based on a predetermined payout ratio.

Preferably, the predefined actions of the table operator include interacting with a table component at times corresponding to specified game events. In one form, the operator uses a dolly for indicating on the table layout the result of each spin of the wheel for a respective game. Preferably the dolly is placed onto and removed from the layout at the respective commencement and conclusion of each payout phase.

Preferably the dolly includes a dolly monitoring system for indicating movement of the dolly.

Preferably, processing the data received from the one or more roulette table components includes identifying threshold periods of inactivity at the chipper.

Preferably, wherein identifying the game delineation events includes processing data from two or more roulette table components.

Preferably, the method includes the step of estimating a game turnover based on the association of portions of the stored chip count data with respective roulette games Preferably, the method includes analysing the timing information for the identified game delineation events, thereby to estimate a rate of game completion.

Preferably, the method includes a step of generating a report indicative of the game turnover based on the value of chips used in each game cross-referenced with one or more other aspects of game data.

Preferably, wherein the one or more other aspects of game data include any one or more of the following:

number of players at the table;

rate of game completion;

game duration;

assigned chip value.

Preferably, the method includes the step of analysing said reports to determine an optimal rate of game completion to maximise the game turnover.

Preferably, the method includes the step of analysing said reports to determine an optimal number of players per table to maximise the game turnover.

Preferably, the method includes providing to a table operator data indicative of the estimated rate of game completion.

Preferably, the method includes providing to the operator data indicative of the estimated rate of game completion and an optimal rate of game completion.

Preferably, wherein providing to the table operator data indicative of the estimated rate of game completion and an optimal rate of game completion includes providing a signal indicative of a suggestion to increase or decrease the rate of game completion.

In another aspect the invention provides a roulette table including a physical roulette wheel, memory module carrying software instructions, and a processor for executing the software instructions, wherein the software instructions configure the processor to perform a method according to the first aspect and any combination of the above preferrments.

In another aspect the invention provides a computer system for monitoring a roulette table, the computer system being configured to perform a method according to the first aspect and any combination of the above preferrments.

In another aspect the invention provides a tangible non-transitive computer readable carrier medium carrying computer executable code that, when executed by one or more processors of a computer system, configures the computer system to perform a method according to the first aspect and any combination of the above preferrments.

In a first preferred aspect the invention provides a method of monitoring consecutive games of roulette played at a live roulette gaming table, the table including:

a table layout;

a roulette wheel; and a chipper machine for sorting and counting betting chips;

whereby each game, players bet on a spin of the roulette wheel by indicating bets on the table layout with the chips, the method including the steps of:

receiving chip count data from the chipper machine;

recording game activity data from one or more gaming table monitoring systems;

processing the game activity data to identify at least one game delineation event and associated timing information;

analysing the chip count data based on the timing information for the identified at least one game delineation event: and associating portions of the chip count data with respective roulette games.

Preferably, the chip count data includes the number of chips counted by the chipper machine.

Preferably, the method includes allocating each player a plurality of a unique type of betting chip, and wherein the chip count data includes the number of each type of chips counted by the chipper machine.

Preferably, the gaming table includes a dolly for indicating a winning outcome on the table layout and wherein the gaming table monitoring systems include a dolly monitoring system for monitoring the dolly and providing game activity data.

Preferably, the dolly monitoring system provides a payout start signal indicating movement of the dolly onto the table layout and wherein the payout start signal indicates the game delineation event.

Preferably, the dolly monitoring system provides a payout end signal indicating movement of the dolly from the table layout and wherein the payout end signal indicates the game delineation event.

Preferably, the gaming table monitoring systems include a roulette wheel monitoring system for monitoring roulette wheel activity and providing game activity data.

Preferably, the wheel monitoring system provides a ball-in-rim signal indicating the presence of a roulette ball spun in the rim of the roulette wheel and wherein the ball-in-rim signal indicates the game delineation event.

Preferably, the wheel monitoring system provides a no-more-bets signal indicating that a roulette ball spun in the rim of the roulette wheel has slowed to a predetermined angular velocity and wherein the no-more-bets signal indicates the game delineation event.

Preferably, the method includes the step of analysing the timing information of predetermined delineation events thereby determining a rate of game completion.

Preferably, the gaming table includes a roulette wheel monitoring system for monitoring roulette wheel activity and providing:

a ball-in-rim signal indicating the presence of a roulette ball spun in the rim of the roulette wheel; and a no-more-bets signal indicating that a roulette ball spun in the rim of the roulette wheel has slowed to a predetermined angular velocity wherein the predetermined game delineation events include at least one of the ball-in-rim signal and the no-more-bets signal.

Preferably, the predetermined game delineation event is the ball-in-rim signal.

Preferably, the gaming table includes a dolly for indicating a winning outcome on the table layout and wherein the gaming table monitoring systems include a dolly monitoring system for monitoring the dolly and providing:

a payout start signal indicating movement of the dolly onto the table layout; and a payout end signal indicating movement of the dolly from the table layout wherein the predetermined game delineation events include at least one of the payout start signal and the payout end signal.

Preferably, the predetermined game delineation events are the payout end signal and the no-more-bets signal and wherein determining the rate of game completion includes determining a betting time value indicative of a betting phase of a respective game.

Preferably, the portion of chip count data includes chip count data from the chipper machine only subsequent to the payout start signal of a respective game.

Preferably, the portion of chip count data ignores chip count data from the chipper machine subsequent to a predetermined threshold period of chipper inactivity following the payout start signal of a respective game.

Preferably, the step of providing output data for each game includes respective chip count data and timing information associated with each payout start, payout end, ball-in-rim and no-more-bets signals.

Preferably, the method includes the steps of:

assigning each type of betting chip a chip value; and estimating a turnover value for each game based on the portion of chip count data and the chip value.

Preferably, the method includes a step of generating a report indicative of the turnover value cross-referenced with one or more other aspects of game data.

Preferably, the one or more other aspects of game data include any one or more of the following:

number of types of chips counted;

rate of game completion;

chip value;

betting time value;

number of types of chips allocated.

In a second preferred aspect, the invention provides a method of determining at least one target value to optimise performance of a live roulette gaming table, the method including the steps of:

monitoring at least one live roulette gaming table in accordance with the first preferred aspect;

recording output data over a predetermined period; and analysing the output data to determine at least one target value of at least one aspect of data.

In a third preferred aspect, the invention provides a method of optimising performance of a live roulette gaming table, the method including the steps of:

monitoring the table in accordance with the method the first preferred aspect to determine a present value of an aspect of game data recorded during a present game period;

comparing the present value with a corresponding predetermined target value;

providing an indication to an operator of the game to modify the aspect in future games to accord with the target.

Preferably, the aspect of game data includes at least one of rate of game completion, chip value and number of types of chips allocated.

In a fourth preferred aspect the invention provides a live roulette gaming table for monitoring consecutive games of roulette played at said table, the table including:

a table layout;

a roulette wheel having a roulette wheel monitoring system for monitoring roulette wheel events and providing respective roulette wheel signals;

a chipper machine for sorting and counting betting chips;

whereby each game, players are assigned a plurality of a unique type of betting chip for betting on a spin of the roulette wheel by indicating bets on the table layout with the respective chips; said table further including:

a dolly for indicating on the layout the result of a spin of said wheel for a respective game; and a dolly monitoring system for detecting movement of said dolly and providing respective dolly movement signals; and a table computer interfaced with said chipper machine, said roulette wheel monitoring system and said dolly monitoring system, said computer for recording chip count data from said chipper machine and attributing it to a respective game in accordance with said roulette wheel and dolly movement signals.

Preferably, said computer records timing information for said roulette wheel and dolly movement signals to determine timing periods for predetermined portions of each game.

Preferably the table is adapted for performing the methods of the previous aspects.

In a preferred form the invention provides a dolly and respective dolly monitoring system for generating game delineation signals indicating game delineating events occurring during consecutive games of roulette played at a live roulette gaming table.

Preferably, said dolly monitoring system includes a sensor for detecting movement of said dolly into and out of a designated area.

Preferably, said sensor includes an induction coil. Preferably said induction coil is located adjacent said area.

Preferably said table includes a table layout for indicting the result of each game of roulette with said dolly by moving said dolly onto a predetermined area on the layout corresponding to the result of the game.

Accordingly, in a fifth preferred aspect, the invention provides a method of monitoring roulette played at a live gaming roulette table, the method including the steps of:

monitoring a plurality of game characteristics, including at least one input characteristic which is controllable and at least one result characteristic which is desired to be optimised; and analysing the monitored game characteristics to determine interrelationships between the result characteristic and the other characteristics.

Preferably, the method includes the step of determining a value or range of the at least one input characteristic in order to achieve a predetermined desired value of the at least one result characteristics given a fixed set of the other characteristics.

Preferably, the method includes the step of controlling the input characteristic in dependence upon currently measured-values for the other characteristics and a predetermined desired value for the output characteristic.

Preferably, the plurality of characteristics include any one or more of: the number of chips counted of each type; the total number of chips; the value of chips; the length of game of roulette; the number of types of chips; the total value of chips of each type; the total value of chips; and the game rate per hour.

In a sixth preferred aspect, the invention provides a method of monitoring roulette played at a live gaming roulette table, the table including a roulette playing area for allowing players to indicate bets placed, a roulette wheel and ball for selecting a winning number, at least first and second types of gambling chips wherein each type of chip is uniquely allocated to a player and wherein each the types of chips are distinguishable from the one another, a chipper machine for sorting chips into the types and counting the number of chips sorted, a data collection computer interfaced with the chipper machine for recording the number and type of chips counted, the method including:

monitoring a plurality of game characteristics including at least one input characteristic which is controllable and at least one result characteristic which is desired to be optimised the plurality including the number of chips of each type counted within a predetermined activity period; and recording the monitored game characteristics with the data collection computer.

Preferably, the activity period is a predetermined period of time.

Preferably, the time period corresponds to a respective game of roulette.

Preferably, the method includes the step of:

defining start and end events of the game;

monitoring the occurrence of respective start and end signals indicative of the start and end events; and allocating the number of chips of each type counted to the respective game.

Preferably a delineation event co-defines the start event of a current game the end event of an immediately preceding game in a sequence of games.

Preferably, the delineation event is defined by a delineation signal generated by an automatic roulette wheel monitoring system.

Preferably, the characteristics include the length of time of each activity period.

Preferably, the method includes the step of:

maintaining an historical record of the game characteristics; and analysing the historical record to determine interrelationships between the result characteristic and the other characteristics.

Preferably, the method includes the step of determining a value or range of the at least one input characteristic in order to achieve a predetermined desired value of the at least one result characteristics given a fixed set of the other characteristics.

Preferably, the method includes the step of controlling the input characteristic in dependence upon currently measured-values for the other characteristics and a predetermined desired value for the output characteristic.

Preferably, the plurality of characteristics include any one or more of: the number of chips counted of each type; the total number of chips; the value of chips; the length of game of roulette; the number of types of chips; the total value of chips of each type; the total value of chips; and the game rate per hour.

Preferably, the input characteristic includes one or more of: the game rate per hour; the table minimum bet; the table maximum bet; and the number of players at the table.

Preferably, the result characteristic is the table turnover per hour.

In another preferred aspect the invention provides a method of monitoring roulette played at a plurality of live gaming roulette tables, each table including a roulette playing area for allowing players to indicate bets placed, a roulette wheel and ball for selecting a winning number, at least first and second types of gambling chips wherein each type of chip is uniquely allocated to a player and wherein each the types of chips are distinguishable from the one another, a chipper machine for sorting chips into the types and counting the number of chips sorted, a data collection computer interfaced with the chipper machine for recording the number and type of chips counted, the method including the steps of:

monitoring for each table a plurality of game characteristics including at least one input characteristic which is controllable and at least one result characteristic which is desired to be optimised the plurality including the number of chips of each type counted within a predetermined activity period;

recording the monitored game characteristics with the data collection computer; and analysing the monitored game characteristics to determine interrelationships between the result characteristic and the other characteristics.

Unless the context clearly requires otherwise, throughout the description and the claims, the words "comprise", "comprising", and the like are intended to be construed in an inclusive sense as opposed to an exclusive or exhaustive sense; that is to say, in the sense of "including, but not limited to".

BRIEF DESCRIPTION OF THE DRAWINGS

Preferred embodiments of the invention will now be described, by way of example only, with reference to the accompanying drawings in which.

PREFERRED EMBODIMENTS OF THE INVENTION

Referring to the figures, the invention provides a system and method for monitoring and optimising the performance of a live roulette table and/or a plurality of roulette tables in a gaming area.

The invention is intended to apply to roulette when played "live" meaning that a physical roulette table is used. Most commonly this will be located in a casino or other premises attended by players in person. As will be clear from reading the following description, the invention is not intended to apply to simulated or online gaming.

A brief description of the game of roulette follows. It is acknowledged that there are variations in the rules and configuration of the game as it is played in different jurisdictions and casinos. Thus, in some implementations of the game, there may be some departure from the description as provided. Nevertheless, the description is presented in order to assist understanding of the invention.

Roulette is a gambling game of chance wherein players choose to place bets on a number, or sub-set of numbers within a larger set. Once bets have been placed, a winning number from the larger set is selected at random and winning bets are paid out based on a predetermined payout ratio corresponding generally, inversely to the chance of the bet winning.

Figure 1:
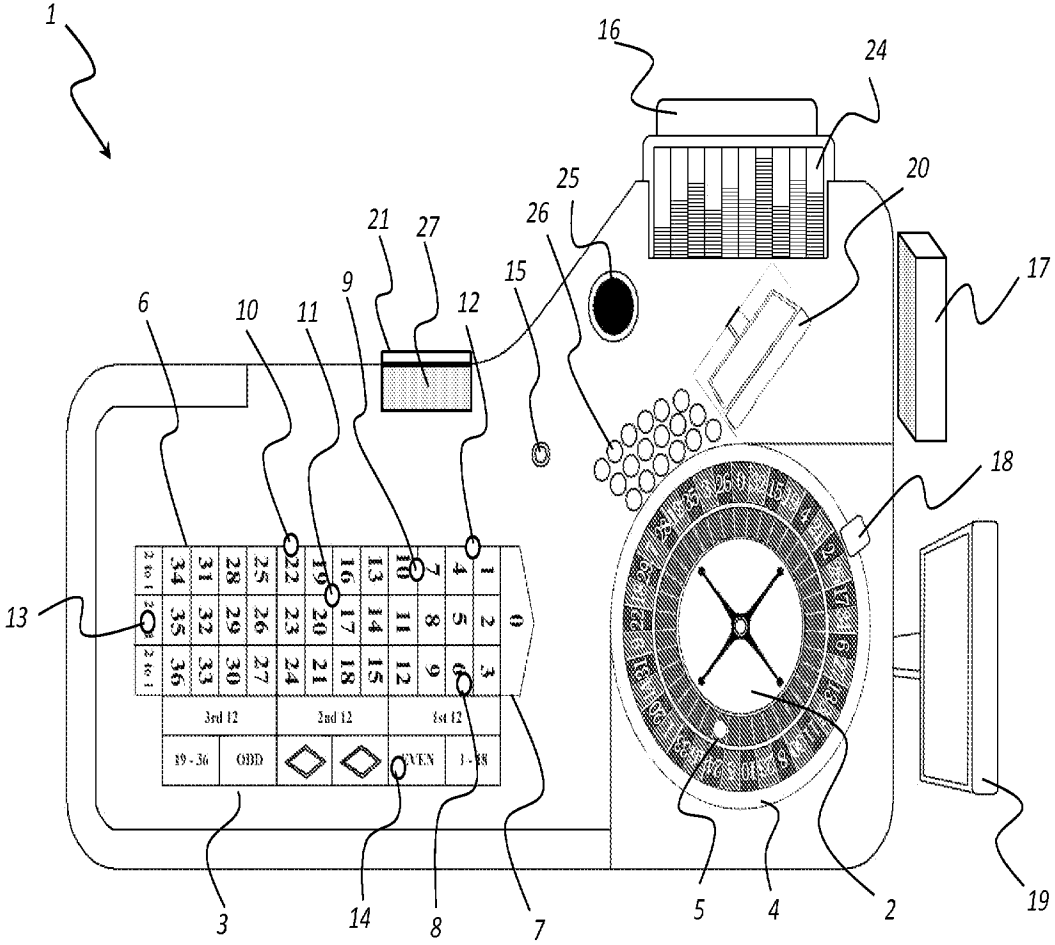
FIG. 1 is a schematic view of a roulette game table in accordance with the invention.

As shown in FIG. 1, the game, when played live in casinos traditionally requires a number of roulette table components. These components include: a roulette table 1 having a roulette wheel 2 for randomly selecting a winning number from the larger set; and a roulette playing surface or layout 3 upon which the players can indicate their chosen bets. One or more table operators known as "croupiers" administer the game on behalf of the casino, operating the roulette wheel, paying out winning bets and generally ensuring honest play in accordance with the casino rules.

The roulette wheel 2 and table shown in the Figures are configured for French Roulette in which there are 37 numbers in the set (0, 1, . . . 36). It can be seen that the wheel is divided, equally and circumferentially, into thirty-seven pockets, each pocket corresponding to a particular number and numbered accordingly. One alternative form of the game known as American Roulette has one extra number in the set; the wheel being divided into thirty-eight pockets numbered 00, 0 to 36. Each number, other than 0 (or 00 in the case of American roulette) is assigned to be either red or black such that there are eighteen red numbers and eighteen black numbers. The Figures are in black and white only however shading indicates black and red numbers. The 0 (and 00) are known as green or "house" numbers.

The roulette wheel 2 is usually mounted for rotation about a vertical axis and is surrounded at its periphery by a stationary, inwardly inclined ball race or rim 4. In operation, the wheel is spun in one direction and a ball 5 placed in track and launched radially to roll around the rim in the opposite direction. As the ball loses speed, it rolls from the outside of the race towards the spinning wheel where it eventually settles in one of the pockets thereby randomly determining the winning number. In the FIG. 1 the ball 5 has settled in the pocket market "24". The roulette wheel normally spins continuously however when launching the ball, the croupier will reverse the spin direction of both ball and wheel from the previous game.

Traditionally, the roulette table layout 3 is a grid which includes defined areas corresponding to each of the numbers in the larger set. The French Roulette table layout shown in the Figures includes a three×twelve grid, 6, defining thirty-six distinct areas corresponding to numbers 1 to 36 from the set. A 13th row 7 for numbers 0 (and 00 in the case of American Roulette) is located at the top end of the grid. Surrounding the grid is a variety of secondary areas designated to allow a players to conveniently select specific, predetermined ranges of numbers.

As with many live gambling games, the game of roulette utilises physical betting chips 8 to facilitate game play and ultimately, to represent a form of table currency usually representing and exchangeable for monetary currency. A player indicates a bet by placing a value assigned chip 8 or number of chips on the area associated with the numbers or groups of numbers they wish to select. For instance, referring to FIG. 1, in order for a player to bet on the number "6", a betting chip or chips 8 is placed by the player within the boundaries of the area marked "6" on the roulette table layout 3. As noted, ranges or combinations of numbers can be selected depending on where and how the chip is placed in relation to the markings on the table. Possible bets include but are not limited to the following:

Selecting one number, such as the number "6", is called a "straight-up" bet. A "straight up" bet is made by placing the chip or chips wholly within the area labelled as "6" on the table.

Two numbers can be selected by placing a chip/s 9 to overlap the boarder of two adjacent numbers. This is known as a "split" bet.

A three-number bet or "street" can be made by placing the chip 10 on the outer edge of one of the rows of numbers.

A "corner" or four number bet can be made by placing the chip or chips 11 on the intersection of 4 numbered areas.

A six-number bet or "double street" is made by placing the chip/s 12 on the outer edge and straddling two of the rows of numbers.

Twelve and eighteen number groups can be selected a variety of ways. For twelve number groups, or "outside dozen" bets an entire column can be chosen by placing a chip/s 13 in one of the "2 to 1" boxes at the bottom of the grid, or by selecting the 1st, 2nd or 3rd 12. An "outside even money" bet on eighteen numbers can be selected by placing a chip or chips 14 in one of the "odd or even", "1 to 18 or 19 to 36" boxes. Also, it is possible to select a red or black "outside even money" group because each number is assigned either a red or black colour. There are 18 red numbers and 18 black numbers.

The payout a winner can expect depends on the type of bet placed and corresponds to the chance of winning less the "house edge" provided by the inclusion of the green 0 number. The chance of the ball landing on any one number in a single spin is one in 37 (or one in 38 for American Roulette) while payouts are based on an even money bet of 36 numbers. For instance, the chance of winning a straight-up one number bet is one chance in 37 (36 to 1). A player winning a straight up bet will paid out 35 chips in addition to recovering the bet chip (35 to 1).

A player may reduce his risk by making a bet covering a greater range of numbers. For instance, the chance of winning an even-money bet is much greater at 18 in 37. However, the return on such a bet is much reduced, the winning payout only one chip plus the wagered chip (1 to 1). A table of the odds and corresponding pay out for a range of bets are presented in the table below.

| Bet common name | Winning spaces | Payout | Odds against winning |
|---|---|---|---|
| Straight up | Any single number including 0 | 35 to 1 | 36 to 1 |
| Split | any two adjoining numbers vertical or horizontal | 17 to 1 | 17.5 to 1 |
| Basket | 0, 1, 2 or 0, 2, 3 | 11 to 1 | 11.33 to 1 |
| Street | any three numbers horizontal (1, 2, 3 or 4, 5, 6 etc.) | 11 to 1 | 11.33 to 1 |
| Corner | any four adjoining numbers in a block (eg 17, 18, 20, 21 ) | 8 to 1 | 8.25 to 1 |
| Six Line | any six numbers from two rows (eg 28, 29, 30, 31 , 32, 33) | 5 to 1 | 5.167 to 1 |
| 1st Column | 1, 4, 7, 10, 13, 16, 19, 22, 25, 28, 31, 34 | 2 to 1 | 2.083 to 1 |
| 2nd Column | 2, 5, 8, 11, 14, 17, 20, 23, 26, 29, 32, 35 | 2 to 1 | 2.083 to 1 |
| 3rd Column | 3, 6, 9, 12, 15, 18, 21, 24, 27, 30, 33, 36 | 2 to 1 | 2.083 to 1 |
| 1st Dozen | 1 through 12 | 2 to 1 | 2.083 to 1 |
| 2nd Dozen | 13 through 24 | 2 to 1 | 2.083 to 1 |
| 3rd Dozen | 25 through 36 | 2 to 1 | 2.083 to 1 |
| Odd | 1, 3, 5, . . . , 35 | 1 to 1 | 1.056 to 1 |
| Even | 2, 4, 6, . . . , 36 | 1 to 1 | 1.056 to 1 |
| Red | Red nos | 1 to 1 | 1.056 to 1 |
| Black | Black nos | 1 to 1 | 1.056 to 1 |
| 1 to 18 | 1, 2, 3, . . . , 18 | 1 to 1 | 1.056 to 1 |
| 19 to 36 | 19, 20, 21, . . . , 36 | 1 to 1 | 1.056 to 1 |

It is of course possible for a player to place more than one bet on each game. A player may choose any combination of bets.

To avoid confusion, before starting play, each player is assigned a unique type of betting chip distinguishable from the other chips being used at the table by other players. Normally this task will be performed by the croupier. Various means may be used to distinguish one chip type from another, however, most commonly, each chip type is readily visually distinguishable from those of other players by being a distinct colour, colours and/or having a particular pattern or design. Other types of means that may be used to distinguish types of chips include: size, shape, surface markings or surface texture. In this specification, any reference to a "type of chip" or "chip type" is used to indicate such a unique set of chips as might be assigned to a particular player as distinguishable from other types of chips assigned to another player.

In addition, each type of chip is normally assigned a playing monetary value. Some casinos may restrict all the types of chips played at a table to be all the same set monetary value. This tends to group players at tables corresponding to the value they are willing to wager. On the other hand, other casinos may allow different values to be assigned to different types of chips depending on the request of the player. Thus one player may be playing with for instance, $5 value chips of one type whilst another player, at the same table may be playing with $10 value chips of another type. Depending on the system, the croupier may be able to set a chip type's value when issuing chips.

Modern roulette tables include various electronic and/or computer components to partially automate the game thereby speeding up play and at least reduce the chance of human error. For instance in FIG. 1, the table includes a chipper machine 16, a table data collection and or component control computer 17, an automatic roulette wheel monitoring system 18, a player's display 19, a croupier's display and input panel 20 and a dolly monitoring system 21.

Figure 2:
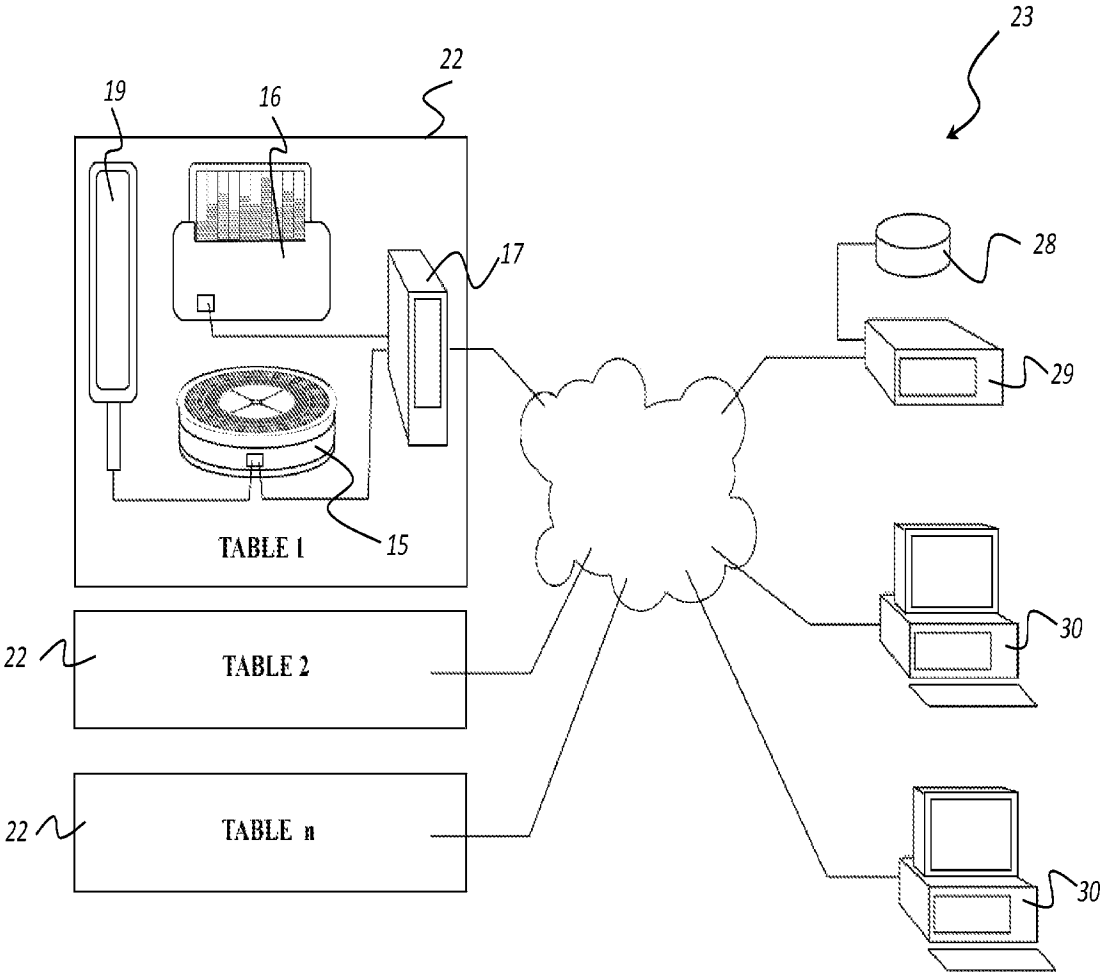
FIG. 2 is a schematic view of a roulette table network in accordance with the invention.

As shown in FIG. 2, these components may be interfaced together on a localised table network 22 enabling transfer of information. In some forms, while each component may rely on inputs from other components on the table, they each attend to their own functions and each may include their own internal processor for doing so. Alternatively, one, more or all of the components may be controlled by a common processing system such as the table computer 17. In either case, whether the table network has a centralized local processor, or individual component processors, reference to the table control computer or data collection computer herein, unless specifically stated otherwise, is intended to refer to either arrangement.

In the embodiment shown in FIG. 2, the localised table network 22 is be connected to and/or part of a larger, wide area network 23 which is be integrated into the casino's computer system. However other network arrangements are possible without departing from the scope of the invention. As shown in FIG. 2, the larger network 23 includes other table networks 22 each associated with a gaming table.

The chipper machine 16 includes sorting and counting mechanisms for sorting chips into types and counting the number of chips of each type sorted. The chipper has chip feed means including an input chute connected to a hopper and chip output means in the form of a chip tray 24 for storing sorted chips. The chute joins an opening 25 through or adjacent to the table playing surface so that chips may be easily cleared or swept from the table surface into chipper hopper where they are funnelled in to the chipper sorting mechanism.

The chip tray 24 is divided into a number of different bays, each bay being assigned to a particular type of chip. Each chip is identified by the chipper and then ejected into the respective assigned bay. In addition, the chip tray bays are configured to stack the chips in columns allowing a predetermined number of chips, usually twenty, to be selected and removed at a time. Thus if the croupier requires chips of a particular type to issue to, or payout a player, they are readily taken from the bay of the chip tray. In some cases the croupier may elect to stack piles of chips 26 in front of the croupier's position for easy access.

The table computer 17 is interfaced with the chipper 16 to record its operation including chips counted and changes to the chip tray. The data collection computer also records the chronology of the changes so that it is possible to track and analyse the changes as they occur over time. The data collection computer may also be interfaced with the other components on the table network such as the roulette wheel monitoring system, the dolly monitoring system and the players' and croupier's displays.

As discussed the table computer 17 may be a passive component which records information from the other components on the table network, and/or an active control component which controls their operation.

The wheel monitoring system 18 detects one or more roulette wheel activities including but not limited to: wheel movement; wheel spin velocity (angular velocity); ball spin velocity (angular velocity); whether the ball is rolling in the rim; wheel segment where the ball exits the rim and drops into the wheel; and a number detection system to automatically detect in which pocket the ball has landed. The wheel monitoring system also generates a "no-more-bets" signal. Usually this is occurs when the ball angular velocity falls below a predetermined value. At this point an indication is conveyed to the croupier and displayed on the players screen. While this signal may be used to end the betting phase, it is normally at the croupier's discretion as to when bets will no longer be allowed in the passage of each game.

The players' display 19 and a croupier's display 20, respectively, present selected information to the players and croupier about the game as it progresses. Information presented to the players may include details about the current and past winning numbers. On the other hand, the croupier's display presents selected information to the croupier which may assist in management of the game. That may include for instance the current games rate per hour, number of chip types in operation (indicating number of players) etc.

The input panel 20 allows the croupier to input certain information and control the various other components on the local network 22. The input system shown in FIG. 1 is combined with croupier's display 20 as a touch screen. In alternative embodiments, the input system is a conventional or unique keyboard. The input system may allow for the croupier to accept payment for chips, record details about the chips issued including the number of chips and monetary value assigned to each type, or simply allow the croupier to indicate and enter when particular events in the play of the game occur. The importance of these inputs will be discussed later. In a further embodiment, the input system enables the croupier to record a player's identification, for instance by swiping a patron identification card through a reader. The patron's identification may then be linked to the type or types of chips that they have been assigned. In this way, information monitored regarding the use of a type of chip may be attributed to an individual patron rather than merely an anonymous player.

The dolly monitoring system in its simplest form indicates when the dolly 15 is in use. Specifically, this may be done by sensing when it is removed from a home area 27 on the table surface. Other systems may record when and/or where the dolly is placed on the playing surface.

Data from the table computer 17 is passed over the network to a central data storage facility 28. The data may be accessed over the network via a central processing computer 29 and computer terminals 30.

At the start of a game the croupier declares that the players may indicate their bets by the placing their assigned chips on the table layout. After a period, the croupier will spin the roulette wheel and then launch the ball into the rim so it orbits the wheel counter to the direction of the spinning wheel. When the ball starts to slow down, before it drops from the rim, the dealer announces that no more bets are allowed and from that moment further placement of chips or altering the position of chips on the playing layout is prohibited.

Shortly thereafter the ball drops from the rim and settles into a pocket on the wheel thereby selecting the winning number. The dealer announces the winning number and places a marker or "dolly" 15 onto the winning number on the layout 3. The dolly 15 allows easy identification of the winning bets and moving it onto the table also marks the start of the payout phase of the game.

During the payout phase, the croupier first clears the losing bets from the table, sweeping the losing chips into the chipping machine chute where they are sorted, counted and returned to the tray.

If any players have made a winning bet, they are paid out by the croupier, normally with their assigned type of chip, unless the win was very large. Normally, the croupier sources the pay chips from the chip tray 24 by taking one or more columns of chips paying out the appropriate number and discarding the rest down the chipper chute 25. This is known as "breaking down". For example, say a player places one chip on a straight up number that subsequently wins. That wager will be paid at 35 to 1, so in order to pay the winning bet the dealer will typically take two stack each containing twenty chips, remove five chips from one of the stacks, and place those five chips down the chipper chute prior to moving the remaining thirty-five chips to the winner.

Finally the croupier removes the dolly to signal the end of the payout phase and that that the players may place bets for the next game.

In this regard the game may be thought of as unfolding in phases. The phases can be seen in FIG. 3 which is a schematic time chart displaying a typical sequence of game play for two sequential games of roulette T and T'. In the chart time progresses from left to right across the page and it is noted that phases may overlap to some degree. The phases as shown are:

A—Betting Phase—during which bets can be indicated by placement of chips

B—Ball Spin Phase—from croupier launching ball in rim to ball drop

C—Payout phase—includes a period of clearing losing bets C1 and then paying out winners C2

D—Chipper Activity Phase (monitored)

The above phases can be tracked or delineated by particular game events which occur during the sequence of each game. It will be appreciated that in some games of roulette, depending on the rules applied, the equipment used and various other factors, the sequence and steps may differ and/or from those in the figure.

31—Game and betting phase start—players indicate bets;

32—Croupier spins wheel and ball—start ball spin phase;

33—Ball slows "no more bets" called and betting phase ends;

34—Winning number announced;

35—Winning number recorded—end ball spin phase;

36—Dolly moved to table and croupier starts clearing losing bets into chipper chute—start of payout phase;

37—Croupier pays out winners;

38—Dolly is moved home—end of payout phase;

31'—Game and betting phase start—players indicate bets;

39—End of chipper activity;

32'—Croupier spins wheel and ball—start ball spin phase;

33'—Ball slows "no more bets" called and betting phase ends;

34'—Winning number announced;

35'—Winning number recorded—end ball spin phase;

36'—Dolly moved to table and croupier starts clearing losing bets into chipper chute—payout phase starts;

37'—Croupier pays out winners.

The invention proposes using the electronic components and monitoring systems installed on the table to generate signals indicating at least some of the above game events, recording and analysing those events. In this way phases of each game may be tracked and recorded. These phases may not be limited to the four above. These aspects will now be discussed in greater detail.

As discussed above, the chipper outputs data regarding the quantity of each type of chip that are being sorted. This information intrinsically contains the total number of chips sorted; the number of each type of chip sorted; and the number of different types of chips sorted.

The data from the chipper can also be correlated to the number of players that have bet on a game because each player is normally allocated a particular type of chip for the duration of that player's time at the roulette table. There may be exceptions to the correlation such as if a player wins and is paid out without the necessity to break down a stack of chips, no chips of that type will be sorted by the chipper for that game. Nevertheless, the number of types of chips sorted for a game does provide a sound indication of the number of players that bet on a game.

In a broad form the invention provides a method for recording the number of games played over a particular playing period and attributing the data from the chipper to that period. More preferably, by recording the number of games played over the particular playing period, the invention provides an average measure of that data per game for the period.

Most preferably, the data from the chipper is recorded for each discrete individual game. In doing so, the performance of the roulette table can be analysed on a game-by-game basis. As will be explained, this preferred embodiment allows both data collection and on the fly management of the tables.

For instance, by recording chipper activity for each game, it is possible to correlate the number of players at the table for each game, and the total quantity of chips sorted for each player for each game and the number of games that each player has participated in per play session.

Whilst the chipper is capable of counting the number of chips of each type sorted, it operates on demand as chips are fed into the inlet chute. Accordingly, in order to correlate the number of chips sorted to each game, it is necessary to devise a method of determining when the chipper has completed counting chips from one game and started counting the chips of the next.

In a simple form the invention relies upon a predetermined game delineation event in the game sequence to provide and indicator which resets or delineates the chipper's count between games. A game delineation signal generated at the game delineation event is used to prompt the system to record the total number and types of chips counted thus far and then reset the chip count to zero so that chips counted from that point forward are attributed to the next game. For instance, the predetermined game delineation event may be taken from the game events disclosed in FIG. 3. In this form of the invention, it is not a requirement to record time data. Rather, the sequence of the game delineation event in chronological relation to the chipper activity is used to divide the chippers count data between games.

However preferably, a measure of time taken for each game is also monitored and recorded. Thus, a preferred form the invention seeks to log the times of the start and end of each game to obtain a measure of the time the game takes, and then attribute a chipper count to the intervening time period. A complexity of this approach is that phases of the game may overlap both within and between sequential games.

In one embodiment because the games are generally played continuously back to back, a single game delineation event simultaneously defines the end of one game and the start of the next. In other embodiments of the invention, separate start and end game delineation events are used to define the start and end points of each game. While logging a single game delineation event has the advantage of reducing complexity, an advantage of logging separate start and end (and predetermined mid game) game delineation events for each game is that it is possible to selectively exclude certain portions of the sequence from analysis.

Either way, it is preferable that the method used to generate the game delineation signals places little, or more preferably, no additional burden on the croupier. Accordingly, in a preferred form, the game delineation signal is generated automatically by the components and systems on the table network.

It should be noted that there may be some disjunction between actual events occurring during the sequence of the game and the table components sensing and registering those events as having occurred. This is generally because the table components may rely on indirect means to determine that a game event has occurred or simply, there may be some lag between the actual event occurring and the respective table sensor registering that it has taken place. For instance, with reference to FIG. 3, it is often possible for the croupier to identify and announce the winning number 35 before the wheel monitoring system senses where the ball has landed in the wheel 34. Thus the no more bets signal may be generated and recorded by the system in advance of the actual no more bets being announced and enforced.

In respect of the invention, unless specifically stated, the game events used to generate game delineation signals are considered to occur when the various table systems sense and register those game events as having occurred.

A method and system in accordance with the invention will now be explained.

The roulette table 1 includes a table layout 3 allowing players to indicate bets, a roulette wheel 2 having an automatic wheel monitoring system, a dolly 15 and dolly monitoring system, a chipper machine 16 for sorting and counting chips and a croupier's display 20. These components and systems are all interfaced with a table control computer 17 for controlling the components on the table and collecting and recording data. The table control computer may be remotely located but is usually discretely located on or under the table itself.

Figure 3:
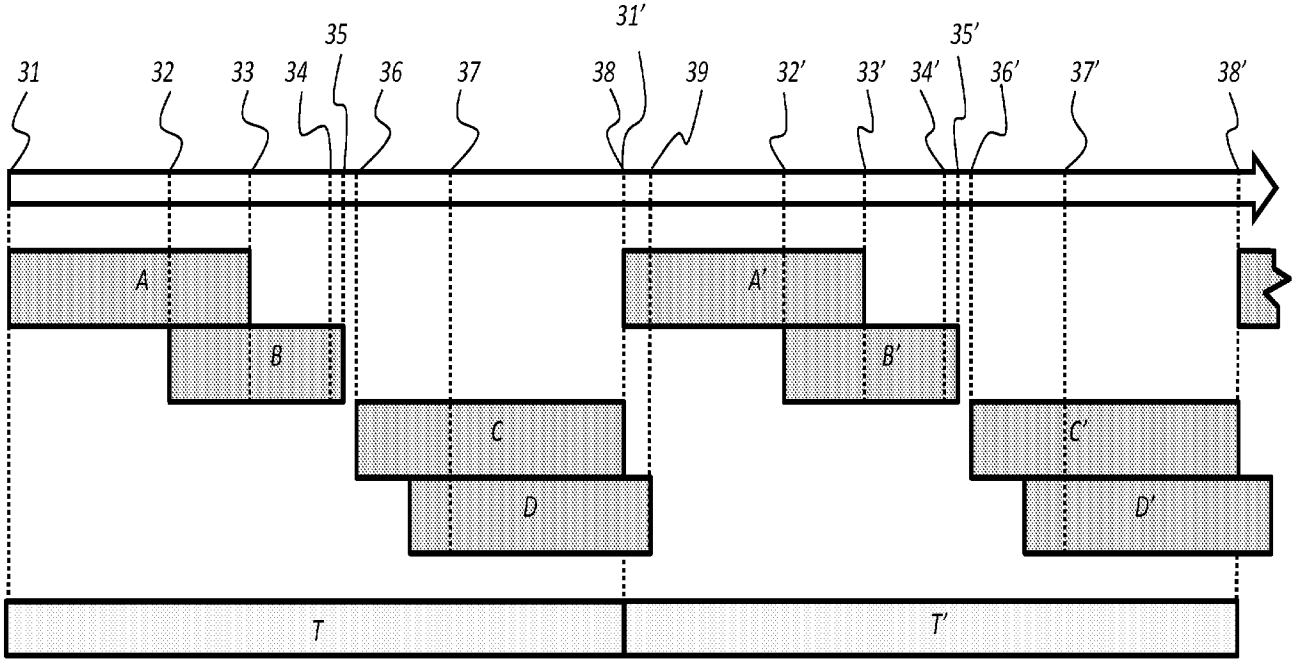
FIG. 3 is a timeline schematic view of a typical sequence of events of a live roulette game.
Figure 4:
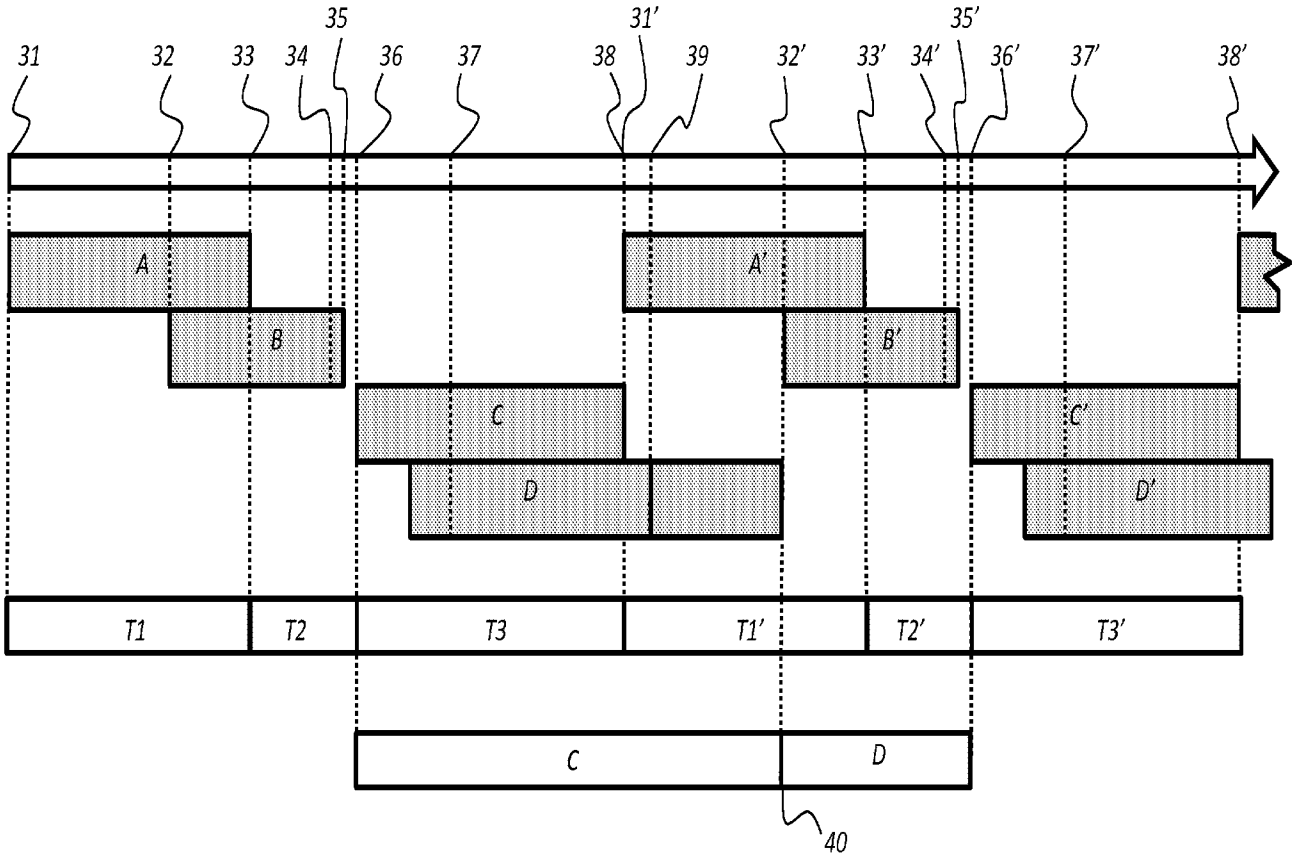
FIG. 4 is a timeline schematic view of a sequence of events of a live roulette game in accordance with an aspect of the invention.
Figure 5:
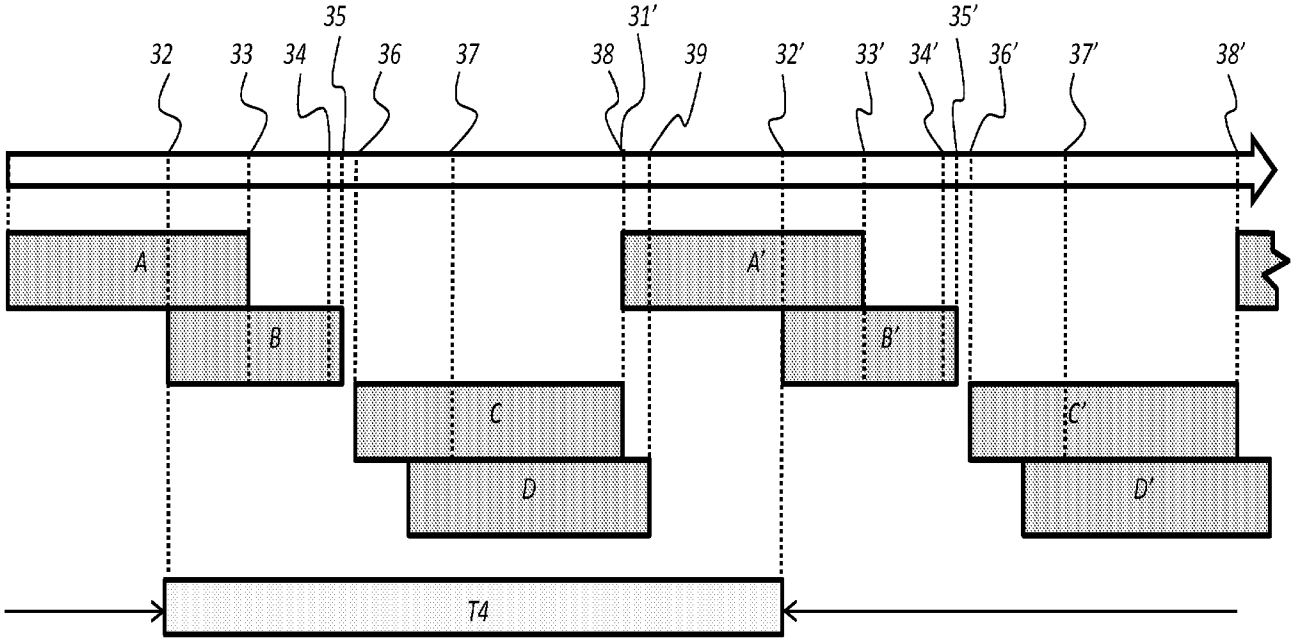
FIG. 5 is a timeline schematic view of a sequence of events of a live roulette game in accordance with another aspect of the invention.

With reference to FIG. 4, the general progress of the game is as previously described in FIG. 3. At the start of each game, the croupier declares that bets may be placed and the betting phase A is initiated. The time at which this event 31 occurs is noted and recorded by the table control computer. After a period of time to allow players to make bets, the croupier initiates the ball spin by spinning the roulette wheel and launching the ball in the rim. The roulette wheel monitoring system senses that the ball is moving in the rim and sends a ball-in-rim signal to the table computer recording both the time it was first detected, and its initial speed.

When the wheel monitoring system determines that the ball has slowed below a predetermined limit, a no-more-bets signal is generated by the wheel monitoring system which prompts a no more bets indicator on the croupier's display. The croupier may use this event 33 as a reference for closing the betting phase by announcing "No more bets" to the players, however ultimately, ending the betting phase is at the croupier's discretion. The time of the no-more-bets signal generated by the wheel monitoring system, is also recorded by the table computer as a timestamp.

Eventually the ball leaves the rim and settles in a pocket on the wheel thereby determining the winning number. Whilst the wheel monitoring system may include sensors capable of establishing where the ball has settled, the winning number is often determined and sometimes announced by the croupier beforehand. Accordingly, with reference to FIG. 4, the actual announcing 34 of the winning number by the croupier is shown to occur prior to the wheel monitoring system recording the data 35.

After, or concurrent with announcing the winning number, the croupier moves the dolly 15 onto the table layout 3 to indicate the winning number. Moving the dolly, 36 in FIG. 4, is sensed by the dolly monitoring system and logged by the table computer. Because the action of moving the dolly marks the start of the payout phase C when chips are cleared from the table and fed into the chute for sorting by the chipper the signal is herein referred to as the payout start signal.

In this embodiment, the dolly monitoring system includes a "home" area or position 21 for the dolly where it can be placed when not on the table layout. Sensors detect the presence of the dolly when it is placed in the home position. The home position may be a designated area 27 on the table layout or a rack, housing or holster for receiving the dolly.

In this embodiment the sensor includes an induction loop in the proximity of the "home" area. As such, the dolly must include a material, such as a ferrous metal which is detectable by the induction loop. The induction loop can be mounted under the home area or embedded in the table cushion adjacent the home area.

Other types of dolly monitoring systems may include any other type of proximity sensor for instance optical or RFID sensors. Still other, less preferred methods used to determine whether the dolly is in the home position may include a physical switch activated by the dolly when it is returned to the home position.

It will be appreciated that in this embodiment, the induction loop detects the presence of the dolly when it is located in the "home" area or position. Thus, a change of state of the sensor from detecting the presence of the dolly to not detecting the dolly can be interpreted as the dolly having been moved away from the home position. As noted, such a change in state will occur when the croupier moves the dolly from the home position on to the table layout at the start of the payout phase C thereby generating a payout start signal 36 which is passed to the table computer.

Conversely, a change of state of the sensor from not detecting the dolly to detecting the dolly indicates that the dolly has been brought back to the home position. As such, once the table is cleared of losing chips, and the winning bets paid out and cleared, the croupier moves the dolly back to the home area thereby triggering the dolly monitoring sensor and generating end payout signal 38 to indicate the end of the payout period C. Again the time of this event is recorded by the table computer.

Casino tables are operated continuously with each game immediately following the last. Thus, as soon as the table is cleared of chips and the dolly, the table is ready to receive bets for the next game A'. With reference to FIG. 4, the end of the payout period C at event 38 also corresponds to the beginning of the next game 31' and start of the betting phase A' of the next game.

In addition, because the start payout and end payout signals generated by the dolly monitoring system are only inferred from dolly movement, the system includes safeguards which direct the croupier to manoeuvre the dolly correctly. In many casinos, the croupier will have few functions to perform while the table is in the betting phase before the ball is spun. It is common for the croupier to play with the dolly, tossing and flicking it in the air, in a similar manner to which a barman will throw glasses and bottles around. However, in order to generate the start payout signal, it is necessary for the dolly to be detected at the home position before being moved away from the home position and placed onto the table layout to indicate the winning number.

In order to prompt the croupier to return the dolly home, the dolly monitoring system includes visual and/or audible reminder indicators. These signals are activated automatically depending on data from the dolly and wheel monitoring systems. In this embodiment, the dolly monitoring system will generate a reminder indicator if the dolly is not in the home position either immediately, or after a predetermined period of time when the no more bets event is determined by the wheel monitoring system. In this embodiment the predetermined period is around five seconds.

In this embodiment, the indicator is a flashing red light directing the croupier to return the dolly to the home position. If the dolly is not returned after a set time period, an audible warning is sounded. When the dolly is returned home, a steady green light illuminates and when the dolly is then removed from the home position, the green light flashes directing the croupier to return the dolly to the home position once the payout phase is completed.

Other dolly monitoring systems avoid the need for these additional measures to direct the croupier by having sensors detect when the dolly is placed on the table layout rather than when it is in the home position. As such, the croupier only needs to ensure that the dolly is placed and removed from the table layout during the payout phase for appropriate start and end payout signals to be generated.

Still other, more complex dolly monitoring systems record where the dolly is placed on the playing surface.

As previously noted chips cleared from the table are sorted and counted by the chipper. The chipper activity is monitored by the table control computer and the totals of each type of chip accumulated. D in FIG. 4 represents the monitored chipper activity phase.

It is usual that the chipper will not have completed sorting and counting all the chips which have been swept into the chipper hopper before the croupier has returned the dolly home indicating the end of the game. Accordingly, rather than ignore the chips not yet sorted and counted, the invention makes provision for "chipper lag" allowing additional time for the chipper to finish processing chips. The monitored chipper activity phase D continues until the chipper has either experienced a threshold period of inactivity of more than a predetermined length of time, in this embodiment, 8 seconds, or the no-more-bets signal has been generated for the next game. Whichever of these events comes first marks the end of the monitored chipper activity phase. While normally chipper activity might end shortly after the table is cleared, as referenced as 39 in FIG. 4, the maximum length of time the chipper activity will be monitored is referenced by 40. Further chipper activity is ignored by the table control computer which records the current totals of number of chips counted for each game in the primary database. Accordingly, in extreme cases of chipper lag, all chips utilised during the game may not be included in the chipper count totals.

Note that chipper will continue to sort any chips in the hopper whether they are game chips cleared from the table, chips used in brake down paying out winners, or chips from breakdown when exchanging chips for currency. The chipper count activity will continue to be ignored until a later predetermined reset event in the progress of the subsequent game when the chip count restarted from zero. In this embodiment the reset event is trigged by the dolly monitoring system sensing the dolly has been moved from home. Thus with reference to FIG. 4, the maximum chipper activity time which is recorded is represented by C while D represents the minimum time in which the chippers activities will not be recorded.

At the conclusion of the monitored chipper activity phase the table control computer has stored at least the following data:

Game Start: Time Stamp
No-more-bets: Time Stamp
Winning Number: Number
Start Payout: Time Stamp
End Payout: End/Start Game: Time Stamp
Chipper count: Number of each type of chip sorted.

The end of the chip count prompts the table computer to process the above data. A simple routine calculates the length of time of each of the following:

Betting Phase T1 (from end payout phase time stamp 31 to no-more-bets 33);

"Dead" Phase T2 (from no-more-bets 33 to start payout 36); and

Payout Phase T3 (from start payout 36 to end payout 38).

Referring again to FIG. 4, the time periods T1, T2 and T3 are shown on the time flow chart schematic. It will be appreciated that the sum of time periods T1, T2 and T3 should reflect the duration of each game from the start of the betting phase to the end of the payout phase (start of the subsequent game's betting phase).

These three time periods may each be analysed separately. T1 represents the length of time provided for the patrons to place bets and as such, is generally the most significant in terms of analysing and optimising game speed to maximise turnover. It is also perhaps the period over which the croupier has the most control in terms of its duration.

T2, the "dead" time should in theory be reasonably constant because it is measured from the no more bets signal generated by the wheel monitoring system until the dolly is moved onto the table. Most of this period is taken waiting for the ball to slow from the predetermined no more bets velocity to allow it to fall from the wheel rim.

T3 is a measure of the time it takes the croupier to clear the table layout. By relating the length of the period to the number of chips counted by the croupier, some measure of the croupier's efficiency may be determined.

The time period values T1, T2 and T3, are written into a primary database in the table control computer as a discrete game data packet along with the number of each type of chip sorted by the chipper. The time stamp of the start of the betting phase 31 is also written into the primary database as a means for indentifying each came. It will be appreciated that in this way, the chipper output for each discrete game can be individually recorded along with time data relating to the game.

It is also possible to record other data particular to each game. Such data may include:

data identifying the croupier;
information regarding the table betting value or value of each type of chip assigned; and
information regarding the chips which were in play at that table during any particular game (this may be less than the number of chip types for instance, if a player has not bet on a spin).

In other forms of the invention data is recorded regarding which chips have been assigned to a known patron if such information is available and has been entered when the chip was assigned.

It is accepted that some of the data will contain inherent error. For instance, if a particular player did not lose any chips in a particular game, the number of players as determined by the computer may be lower than the number of players who participated in that game. In addition, as previously discussed, due to breaking down procedures and chipper lag, the number of chips sorted may not accurately reflect the actual number of chips lost by each player.

Furthermore because the time periods T1, T2 and T3 are derived from signals generated to indicate actual events, there may be slight differences in timing. For instance, the real time players have to place bets may not always accord with the recorded T1 time. This is because in practice, it is not uncommon for players to begin placing bets on the table before the croupier has finished the payout phase and returned to the dolly to the home position.

These discrepancies may be dealt with by adjusting the data with appropriate correction factors and/or algorithms depending on how the data is to be used and whether the inherent errors will skew the results. On the other hand, when used for comparative purposes, the inherent errors may be ignored.

The invention also proposes alternative systems and method not including dolly monitoring system signals for indicating delineation events. In such systems, an alternative delineation event must be determined. In some forms manual inputs may be used. However in the system described below, only automatic data from the other table components are used.

Such systems must also take into account chipper lag. One proposed method of accounting for chipper lag is to align the monitored chipper activity with the game sequence by using the same game event to delineate game play time as well as chipper activity. Thus, if chips are not to be excessively ignore in the totals, it is preferable to set the delineation event as late as possible thereby providing additional time for the chipper to process chips. In this case, the game delineation event may lag the real progression of the game such that the delineation event occurs during progress of the following game.

As previously noted the automatic wheel monitoring system monitors a number of factors any of which might be used as a signal for the game delineation event. For instance, any action performed and able to be recorded by the wheel monitoring system from when the wheel is spun, or the ball is launched in the race ("ball-in-rim") to when the wheel registers the winning number.

Evaluating the changing rate of chip sorting activity throughout the course of a game is another method of generating a signal to define a game delineation event. In a simple form, a period of inactivity by the chipper over a preset length of time is used to indicate a new game. Of course delineating the games according to chipper activity presents difficulties should the chipper not have completed processing chips from a game before the next game's chips are swept into the chute. Thus, chips from the earlier game may be confused with those of a later game.

Alternatively, a manual switch to be operated by casino staff may be used to signal the start and/or end of the game. Manual triggering of a signal has the advantage of great flexibility but the disadvantage of manual error. If the croupier forgets to activate the switch, the data from the chipper will be incorrectly allocated and skew the results.

Another method is the use of a camera connected to a machine vision system that analyses roulette ball or human motion around the table.

Another method includes an automatic clock or timer mechanism. It will be appreciated that such a method has considerable limitations and would be generally only be used in conjunction with another delineating signal method.

One alternative implementation of the invention will now be described. The chipper and the roulette wheel are interfaced with the table computer. Continuously, but at discrete intervals (every 2 seconds in this embodiment), the number of each type of chip counted by the chipper is recorded and logged in a secondary log along with a corresponding time stamp. At the same time significant events monitored by the wheel are recorded and time stamped as they occur. These are:

- Ball-In-Rim (when the dealer has spun the ball);
- No-More-Bets (when the ball slows to a predetermined speed);
- Winning Number (where the ball lands); and
- Timeout (in case no winning number is detected within a predetermined timeframe).

In the passage of the game, assuming players have been issued chips, the croupier starts each game by allowing players to place bets on the layout. After brief period the croupier spins the wheel and launches the ball into the rim. In this embodiment, the ball-in-rim signal is used as the primary game delineation signal and defines the game delineation event.

It will be appreciate that in contrast to the previous described method having a dolly monitoring system, in this method, both the time data and chipper count data are delineated by the same event. Thus the time data for a particular game does not include the portion of that game from the start of the betting phase to the start of the ball spin phase and rather, includes this same portion from the next game. This is necessary because as previously noted the chipper generally requires additional time after the table declared ready to receive bets for the next game.

When the ball drops and the losing chips are swept into the chipper chute, the chipper automatically begins sorting and counting the chips. The secondary log is updated every 2 seconds with the number of chips of each type counted. It is unimportant if the log is cumulative as the count for the game may be derived either way. This continues whilst the winning bets are paid and break down chips are placed into the chipper chute and added to the count total. Once the table is cleared and reopened by the croupier, bets can be placed for the next game. However, from a data perspective, the current game does not finish until the next game delineation event or ball-in-rim signal is generated and recorded during the very next game.

Normally at the time the ball-in-rim signal is generated, the chipper hopper is empty and the chipper is dormant. At that point the totals from the chipper since the last game delineation event, along with a time stamp, are recorded by the data collection computer in a primary log.

It is anticipated that the chipper may not have completed counting and sorting chips in the hopper when the next ball-in-rim signal occurs. Clearly, whether the chipper is finished before the next game delineation event will depend primarily on the throughput of the chipper, the number of chips swept into it and the speed of the game. However, in the present embodiment, should the chipper still be counting the previous games chips at the next game delineation event, the totals from the chipper since the last game delineation event are not written to the primary log immediately. Instead, the computer monitors the chipper until it is inactive for a continuous period of eight seconds before totalling the chipper count and writing to the primary log. The time stamp for the game delineation event remains that at which the ball-in-rim signal was recorded.

From this raw data captured and recorded by the table computer, a multitude of parameters which have an effect on to the performance of the roulette game can be ascertained. The parameters may be directly measured or simply derived. Some of the parameters include but are not limited to:

- Number of chips counted of each type
- Total number of chips
- Value of chips
- Length of game
- Rate of game completion
- Length of payout period
- Number of types of chips
- Total value of chips of each type (player)
- Total value of chips (total turnover)
- Total number of players
- Game rate (spin rate) per hour
- Number of new players to game (didn't play previous game/s)
- Number of continuing players (played previous game/s)

Number of discontinuing players (played previous game/s but did not play current)

In a first alternative the count of chips may not be directly allocated to a respective game. Rather, the count of games and chips can be made across set periods of time. Hence even without a means of relating each game directly to a chip count, the invention covers the scenario whereby blocks of time are considered instead. For example, a set of statistics could be produced for each 2 minute block of time—number of games, total quantity of chips sorted per block, number of players per block, and so on. Alternatively, the system might be used to monitor each croupier shift. Again, by time stamping each event, the time period to be analysed can be chosen post data recording.

Returning to the preferred embodiment, the recorded data may be used in a variety of ways. In one aspect it can be used immediately and with minimal processing to display particular information to the croupier as the game progresses. For instance, in addition to traditional data presented to the croupier by means of the automatic roulette wheel, the system can display details such as the rate of game completion (a measure of the number of games completed in a particular time period) or the number of players at the table.

In another aspect the data may be used as a basis for making reactive decisions regarding immediate operation of the casino roulette tables. For instance it can be useful for the casino operator to know the number of roulette players at any time. On the one hand each table can only accommodate a finite number of players, whilst on the other hand there are expenses associated with maintaining an open table. Knowing the number of players allows tables may be opened or closed in accordance with demand.

In the case of a small casino where there may be one or a relatively small number of roulette tables, a manual count of players is effective. However, in large establishments, with many tables in operation, determining a good approximation of the number of players may be more difficult. Equipping a number of tables with the system and centrally analysing data from all tables collectively and/or comparatively provides for simultaneous, instantaneous, relatively accurate and convenient monitoring of player numbers.

In another aspect the data may be used to identify key customers for loyalty programmes and advertising. If a patron is registered with the casino, and a link between a chip type and that player is provided by recording the payer on the system when allocating chips, the system can provide an indication of that patron's activity at the table. While individual bets may not be traced, the number of chips counted will give an indication of the takings from that player albeit given the inherent errors discussed.

In the above uses, the data is generally monitored in real time, the parameters are either directly calculated from the data collected or simply derived. However in another aspect of the invention, the data may be used to set targets values for aspects of the game with a view to maximising turnover on an individual table or collective basis.

In this aspect, the system is utilised to automatically collect table performance data over an extended and possible open ended period, for instance, several weeks, months or years. Data is collected and compiled from individual or multiple tables. By careful review and analysis, a body of statistical information is compiled to determine how recorded parameters interrelate.

It will be appreciated that within the set of parameters, there is a subset of input parameters that are directly controllable by the table operator, at least within a particular range. Controllable input parameters include but are not limited to the value of the table minimum and maximum, the duration of each game and the number of players at the table.

The table minimum and game duration can be predetermined or at least influenced directly, while the number of players may be indirectly controlled by opening or closing roulette tables and by setting a maximum number of playing positions per table. The number of operating tables not only affects the number players per table, to a degree, but also the labour requirements and associated operating costs.

Similarly, there exists a subset of parameters that cannot be directly controlled by the table operator but may be influenced by the other parameters. These result parameters include the total number of players and to some extent, the number and size of the bets made and perhaps most significantly the table turnover and total turnover.

In addition, a third set of parameters may also influence the relationship between the controllable and result parameters. This third set of parameters are generally fixed and might include the time of day or day of week, the time till closing, associated taxes and duties, royalties and staff expenses. Fixed parameters may even include specifics about a particular room, casino, or time of year.

In general terms, the data analysis seeks to determine how the input and fixed parameters affect one or more result parameters. The accumulated data can be analysed to optimise the performance of the table to maximise table turnover and game efficiency, while minimising costs and staff requirements.

One simple form of analysis is to consult the database and construct a picture how variations of one input parameter affects the result parameters given that the other input and fixed parameters are set. The analysis process is repeated for each combination of input parameters and fixed parameters.

It should be noted that in order to have any validity, the data captured needs to be genuine. Consequently, the larger the database the more accurate the understanding of the interaction between parameters can be achieved.

By reviewing any trends in the data target values for the input data may be determined so as to optimise one or more result parameters. Of course in the case of a random relationship, it may not be possible to determine an optimisation value.

Figure 6:
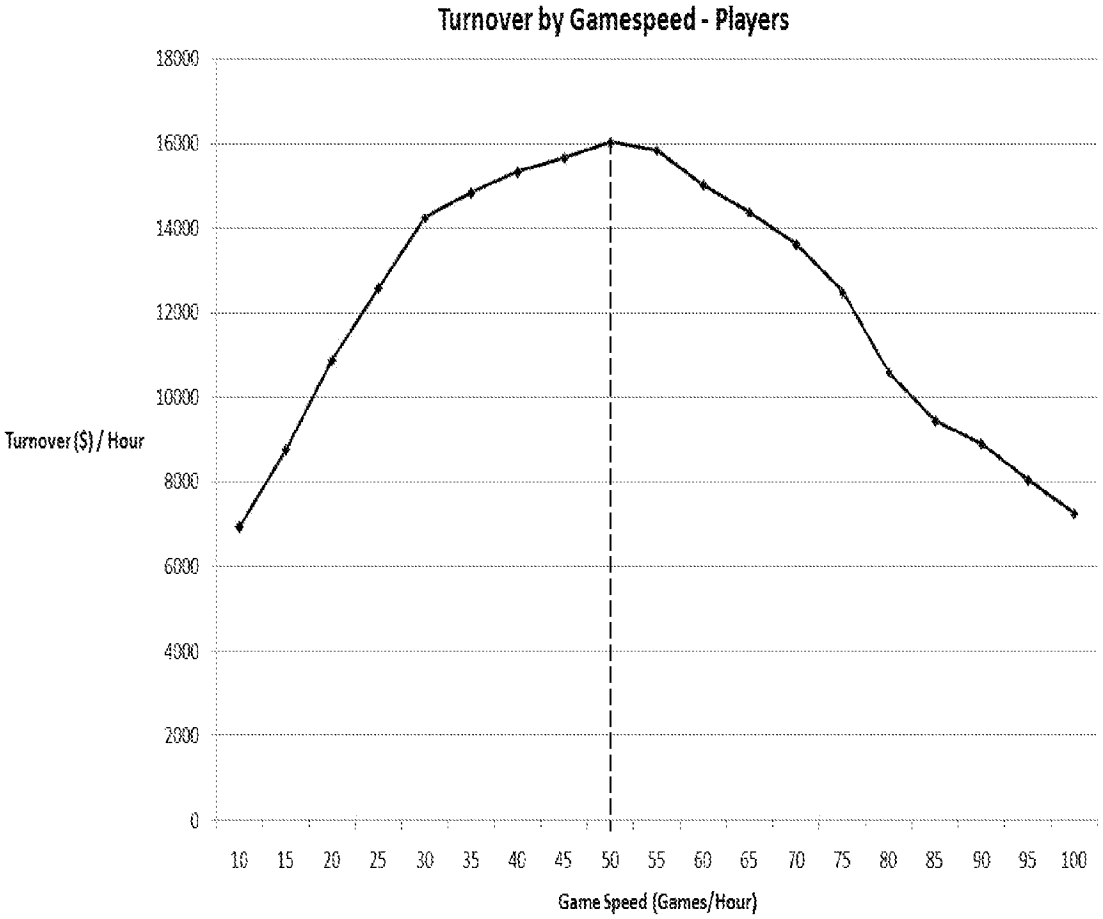
FIGS. 6 to 11 are charts exemplifying the presentation of data for review and analysis in accordance with the invention.

One example of data is shown in FIG. 6 which is a plot of "turnover per hour vs games played per hour". The chart indicates that turnover increases with increasing game speed until at around fifty games per hour, where it then decreases. In this simple example it would appear that initially, the faster the rate of games, the more games played and the higher the turnover for a given period. Eventually however, the rate of games becomes too fast either perhaps psychologically turning customers away from playing and/or simply because customers do not have sufficient time to place bets. While the nature of the relationship might be explainable and even expected, it is not predicable or obvious at what game speed the maximum turnover is achieved.

This simple example shows how it is possible to analyse the data and determine, a trend or relationship between the data. For instance, under a given set of parameters, what value of an input parameter will maximise the value of a result parameter. Accordingly for a given set of circumstances, a target value or range of input parameter may be set to optimise a particular result parameter.

The above example data suggests that to maximise the turnover, a game speed of around fifty games per hour should be maintained.

The example displayed in FIG. 6 only accounts for the variation of one controllable parameter. There is no record of how the number of players in each game affects turnover. Accordingly, FIGS. 7 & 8 account for the variation of multiple parameters. As with the chart shown in FIG. 6, the charts displayed in FIGS. 7 & 8 both plot "turnover per hour vs games played per hour". These charts however, include multiple trace lines in order to account for a variation in the number of input parameters.

Figure 7:
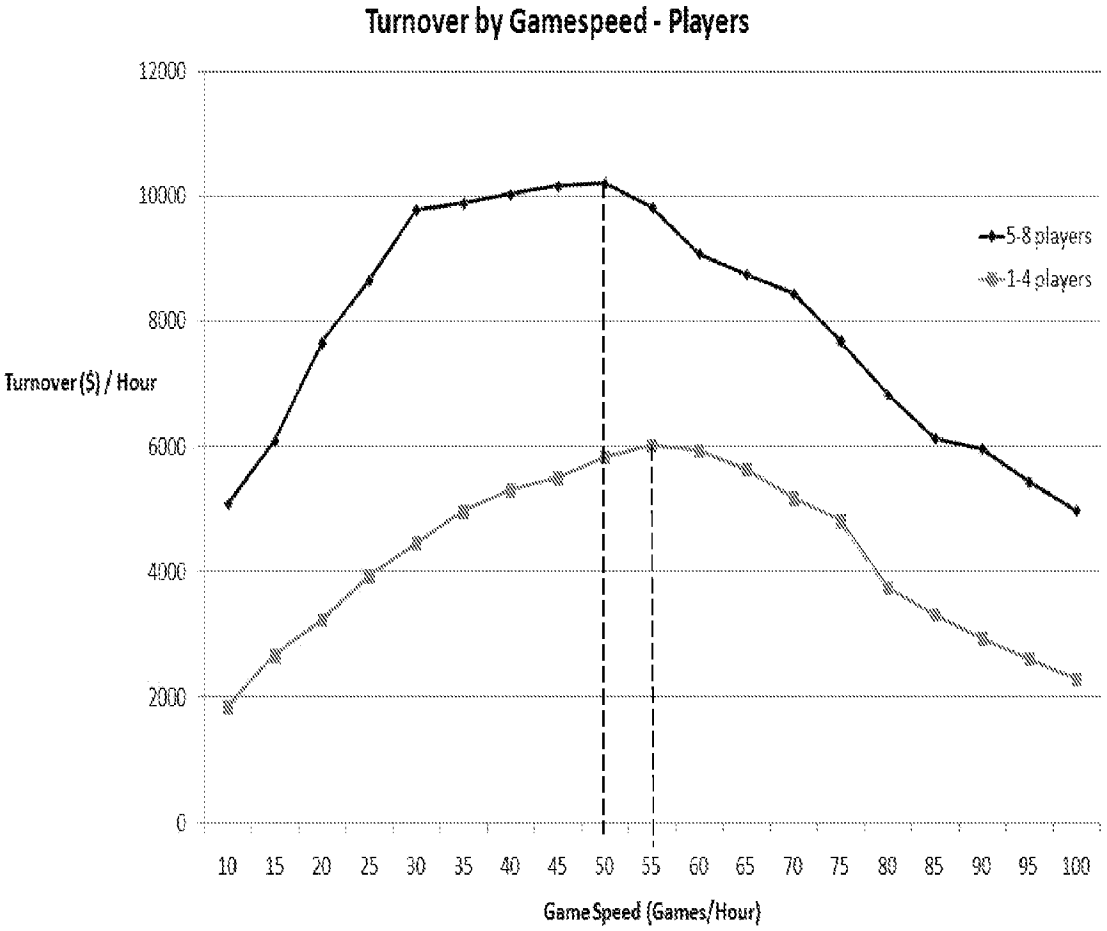
Figure 8:
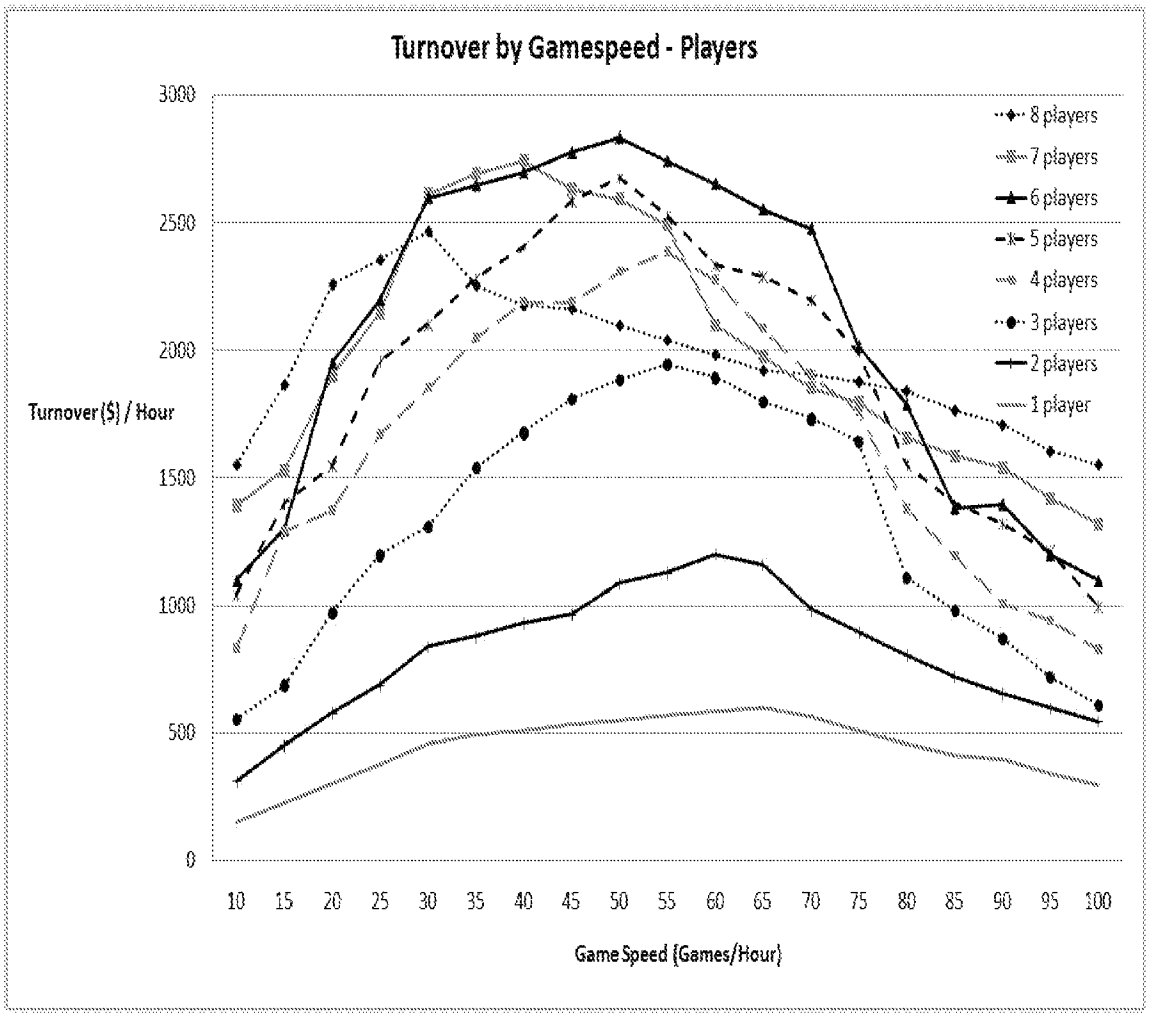

Specifically the chart in FIG. 7 shows trace lines for "turnover per hour vs games played per hour" for when there are one to four players in a game and when there are five to eight players in a game. It would appear to indicate that with a larger number of players in a game, the optimal number of games per hour for maximising turnover is less than with a smaller number of players. Breaking these figures down even further, FIG. 8 traces the performance of "turnover per hour vs games played per hour" for 1, 2, . . . 8 players.

Figure 9:
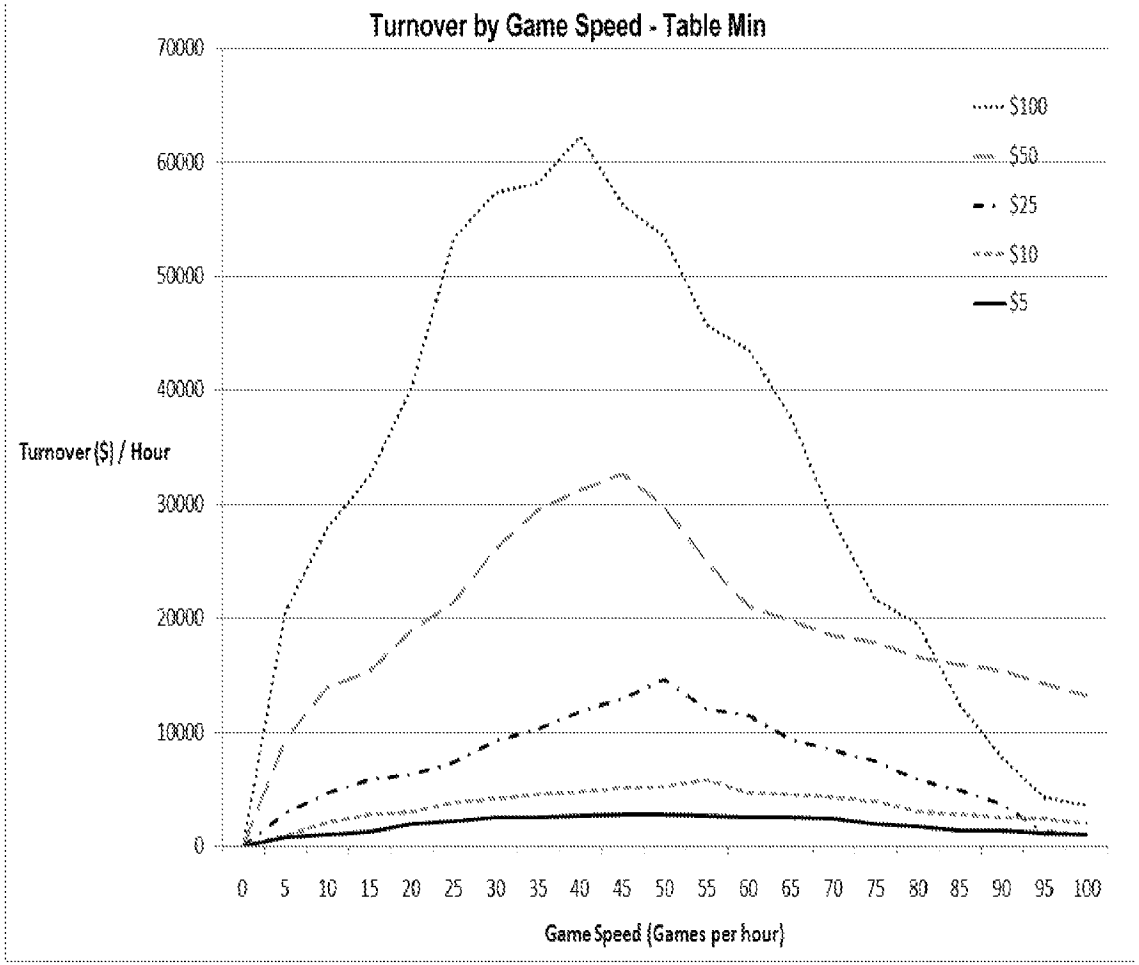

The charts shown in FIG. 9 again plots "turnover per hour v games played per hour" but in this case rather than display traces of the number of players, the chart shows how varying the table minimum parameter may change the optimisation point of games per hour for turnover. For instance in maximising turnover, the optimal games per hour might be less at a table having a larger minimum bet than a table having a very small minimum bet.

Figure 10:
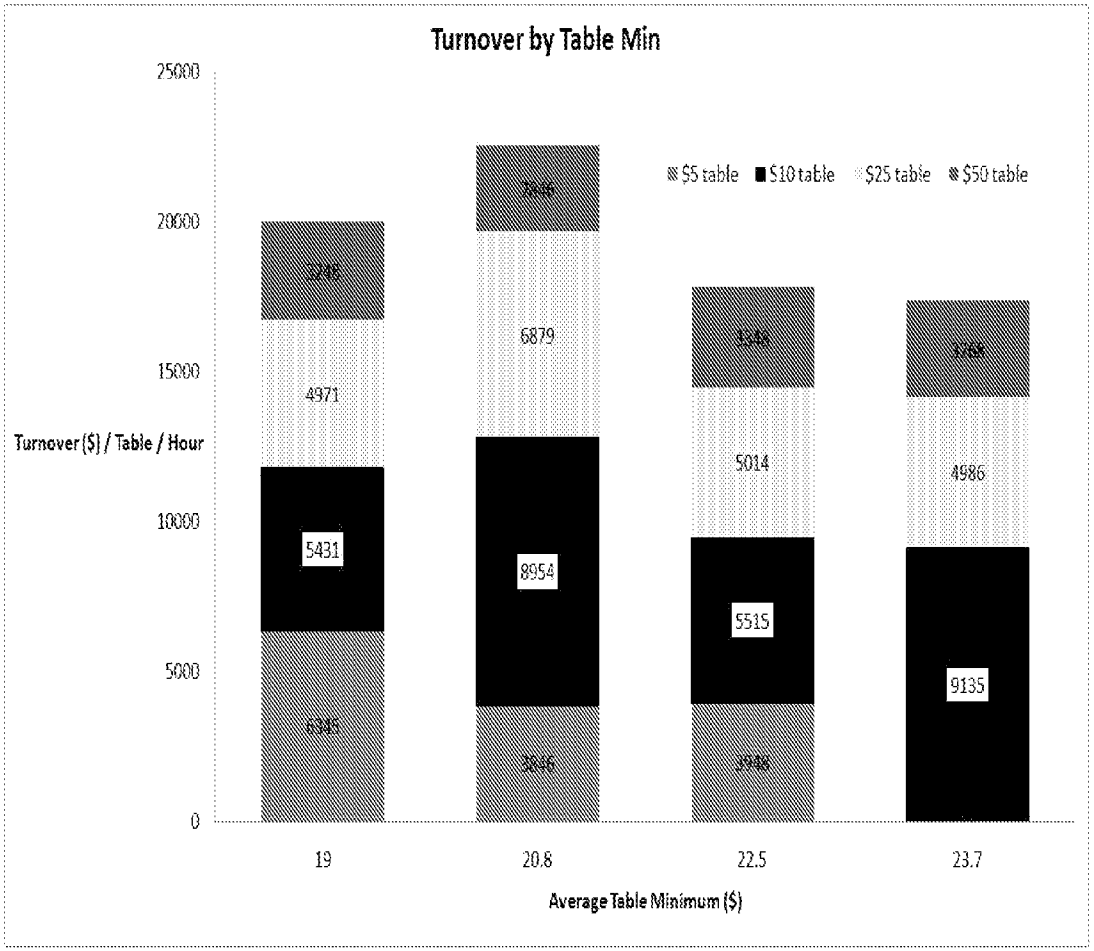

The chart shown in FIG. 10 shows the turnover per table per hour. Each of the four bars is broken down into the turnover per table per hour of each table minimum. The number of tables at a particular minimum is not shown but an overall average table minimum is. This graph is intended to aid in optimising the breakdown of table minimums to maximise turnover. Put another way, to aid the casino in determining how many tables of each $5, $10, $25 and $50 minimum they should have open.

Figure 11:
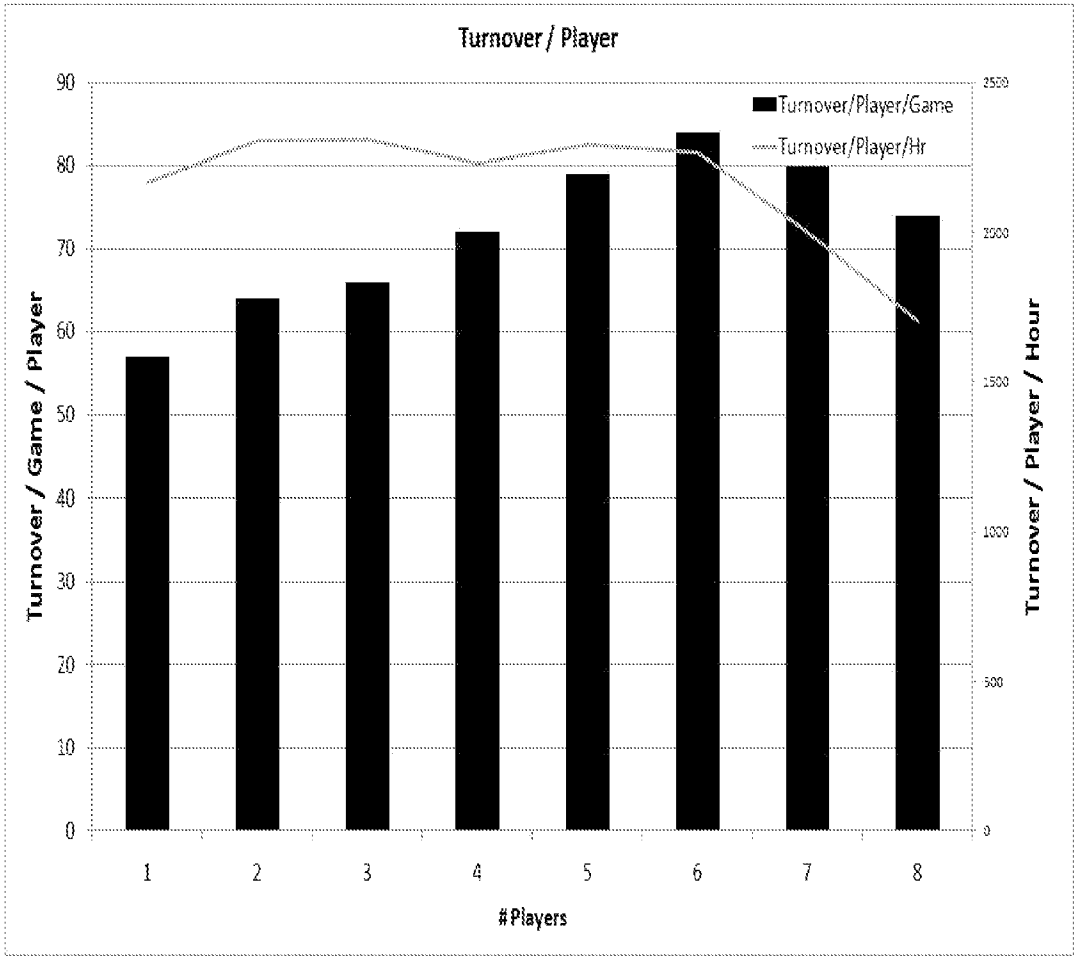

FIG. 11 compares the turnover per player per game to the turnover per player per hour. It suggests that while the turnover per player per game might peak at 6 players, the actual turnover per player per hour is reasonably linear from 2 through to 6 players. This chart highlights the need to select the right parameters to optimise.

The above charts are only indicative of methods used to analyse data and determine optimisation targets values for the controllable input parameters with a view to maximising table turnover and efficiency. A more complex evaluation and optimisation analysis may be performed and ultimately arrive at models, tables and or formulae which are used to determine targets for a vast array of circumstances.

In addition to determining the optimisation targets, in another aspect to the invention the targets can be applied to (the set of circumstances) as defined by the live data captured by the system. In this way it is possible to optimise the result parameters by adjusting one or more of the input parameters. For instance, if at a roulette table there are eight players and the table minimum is set, the croupier maybe spinning at 35 games per hour. However, based on historical data, it has been determined that under those circumstances, the maximum turnover will be achieved at a game rate of 41-44 games per hour. The system is able to instantaneously pass this information to the croupier by presenting the current and target game rate on the croupier's display.

In operation, the system records these parameters and via the net work, consults the central data base and/or central processing computer which returns the target parameter games per hour previously calculated for the number of players and table minimum.

It will be appreciated that the above example is relatively simplistic, only relying on two parameters to determine a target for a third parameter that can be varied by the croupier on one roulette table. However, it is anticipated that multiple parameters may be monitored to determine targets for multiple input parameters across multiple roulette tables.

For instance, in a more complex example, the input parameters are monitored on a plurality of roulette tables operating simultaneously. These parameters are all passed back to the central processing computer which again, based on historical data, provides not only the target spin rate for each table, but also whether additional tables are required to cater to demand, (or should be closed) and to maximise the collective table turnover. In doing so, the targets will take into account additional parameters such as the cost/saving for opening/closing a table, and the preferred table minimum if a new table is to be opened. This information can be communicated to casino management to make running decisions on operation.

Unless specifically stated otherwise, as apparent from the following discussions, it is appreciated that throughout the specification discussions utilizing terms such as "processing," "computing," "calculating," "determining", analyzing" or the like, refer to the action and/or processes of a computer or computing system, or similar electronic computing component, that manipulate and/or transform data represented as physical, such as electronic, quantities into other data similarly represented as physical quantities.

In a similar manner, the term "processor" may refer to any device or portion of a device that processes electronic data, e.g., from registers and/or memory to transform that electronic data into other electronic data that, e.g., may be stored in registers and/or memory. A "computer" or a "computing machine" or a "computing platform" may include one or more processors.

The methodologies described herein are, in one embodiment, performable by one or more processors that accept computer-readable (also called machine-readable) code containing a set of instructions that when executed by one or more of the processors carry out at least one of the methods described herein. Any processor capable of executing a set of instructions (sequential or otherwise) that specify actions to be taken are included. Thus, one example is a typical processing system that includes one or more processors. Each processor may include one or more of a CPU, a graphics processing unit, and a programmable DSP unit. The processing system further may include a memory subsystem including main RAM and/or a static RAM, and/or ROM. A bus subsystem may be included for communicating between the components. The processing system further may be a distributed processing system with processors coupled by a network. If the processing system requires a display, such a display may be included, e.g., a liquid crystal display (LCD) or a cathode ray tube (CRT) display. If manual data entry is required, the processing system also includes an input device such as one or more of an alphanumeric input unit such as a keyboard, a pointing control device such as a mouse, and so forth. The term memory unit as used herein, if clear from the context and unless explicitly stated otherwise, also encompasses a storage system such as a disk drive unit. The processing system in some configurations may include a sound output device, and a network interface device. The memory subsystem thus includes a computer-readable carrier medium that carries computer-readable code (e.g., software) including a set of instructions to cause performing, when executed by one or more processors, one of more of the methods described herein. Note that when the method includes several elements, e.g., several steps, no ordering of such elements is implied, unless specifically stated. The software may reside in the hard disk, or may also reside, completely or at least partially, within the RAM and/or within the processor during execution thereof by the computer system. Thus, the memory and the processor also constitute computer-readable carrier medium carrying computer-readable code.

Furthermore, a computer-readable carrier medium may form, or be included in a computer program product.

In alternative embodiments, the one or more processors operate as a standalone device or may be connected, e.g., networked to other processor(s), in a networked deployment, the one or more processors may operate in the capacity of a server or a user machine in server-user network environment, or as a peer machine in a peer-to-peer or distributed network environment. The one or more processors may form a personal computer (PC), a tablet PC, a set-top box (STB), a Personal Digital Assistant (PDA), a cellular telephone, a web appliance, a network router, switch or bridge, or any machine capable of executing a set of instructions (sequential or otherwise) that specify actions to be taken by that machine.

Note that while some diagrams only show a single processor and a single memory that carries the computer-readable code, those in the art will understand that many of the components described above are included, but not explicitly shown or described in order not to obscure the inventive aspect. For example, while only a single machine is illustrated, the term "machine" shall also be taken to include any collection of machines that individually or jointly execute a set (or multiple sets) of instructions to perform any one or more of the methodologies discussed herein.

Thus, one embodiment of each of the methods described herein is in the form of a computer-readable carrier medium carrying a set of instructions, e.g., a computer program that is for execution on one or more processors, e.g., one or more processors that are part of web server arrangement. Thus, as will be appreciated by those skilled in the art, embodiments of the present invention may be embodied as a method, an apparatus such as a special purpose apparatus, an apparatus such as a data processing system, or a computer-readable carrier medium, e.g., a computer program product. The computer-readable carrier medium carries computer readable code including a set of instructions that when executed on one or more processors cause the processor or processors to implement a method. Accordingly, aspects of the present invention may take the form of a method, an entirely hardware embodiment, an entirely software embodiment or an embodiment combining software and hardware aspects. Furthermore, the present invention may take the form of carrier medium (e.g., a computer program product on a computer-readable storage medium) carrying computer-readable program code embodied in the medium.

The software may further be transmitted or received over a network via a network interface device. While the carrier medium is shown in an exemplary embodiment to be a single medium, the term "carrier medium" should be taken to include a single medium or multiple media (e.g., a centralized or distributed database, and/or associated caches and servers) that store the one or more sets of instructions. The term "carrier medium" shall also be taken to include any medium that is capable of storing, encoding or carrying a set of instructions for execution by one or more of the processors and that cause the one or more processors to perform any one or more of the methodologies of the present invention. A carrier medium may take many forms, including but not limited to, non-volatile media, volatile media, and transmission media. Non-volatile media includes, for example, optical, magnetic disks, and magneto-optical disks. Volatile media includes dynamic memory, such as main memory. Transmission media includes coaxial cables, copper wire and fiber optics, including the wires that comprise a bus subsystem. Transmission media also may also take the form of acoustic or light waves, such as those generated during radio wave and infrared data communications. For example, the term "carrier medium" shall accordingly be taken to included, but not be limited to, solid-state memories, a computer product embodied in optical and magnetic media; a medium bearing a propagated signal detectable by at least one processor of one or more processors and representing a set of instructions that, when executed, implement a method; a carrier wave bearing a propagated signal detectable by at least one processor of the one or more processors and representing the set of instructions a propagated signal and representing the set of instructions; and a transmission medium in a network bearing a propagated signal detectable by at least one processor of the one or more processors and representing the set of instructions.

It will be understood that the steps of methods discussed are performed in one embodiment by an appropriate processor (or processors) of a processing (i.e., computer) system executing instructions (computer-readable code) stored in storage. It will also be understood that the invention is not limited to any particular implementation or programming technique and that the invention may be implemented using any appropriate techniques for implementing the functionality described herein. The invention is not limited to any particular programming language or operating system.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of exemplary embodiments of the invention, various features of the invention are sometimes grouped together in a single embodiment, FIG., or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

Similarly, it is to be noticed that the term coupled, when used in the claims, should not be interpreted as being limited to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Thus, while there has been described what are believed to be the preferred embodiments of the invention, those skilled in the art will recognize that other and further modifications may be made thereto without departing from the spirit of the invention, and it is intended to claim all such changes and modifications as falling within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

It will be appreciated that the present invention provides a method of monitoring and analysing the performance of a live roulette gaming table. The invention provides a system for recoding and analysing the historical performance of roulette tables in order to optimise current performance. It will be appreciated that in these and other respects, the invention represents a practical and commercially significant improvement over the prior art.

Although the invention has been described with reference to specific examples, it will be appreciated by those skilled in the art that the invention may be embodied in many other forms.

The invention claimed is:

1. Roulette apparatus, comprising:

a roulette wheel and a roulette table having a layout for placing of bets utilizing betting chips;

one or more sensors arranged to produce a plurality of signals in response to events during a roulette game indicating a plurality of different phases of the game delineated by said events;

a chipper machine that counts physical betting chips utilized at the roulette table and outputs betting chip count data;

a memory for storing data representing said identified game phases and their associated timing information; and at least one processor for executing instructions to cause the processor to:

a. receive said signals from the one or more sensors;

b. receive timing information for each of the said signals;

c. process said signals and said timing information thereby to identify said different game phases;

d. store the chip count data with associated timing information;

e. analyze the chip count data based on the timing information for the identified game delineation events, thereby to associate portions of the stored chip count data with respective roulette games;

f. estimate a game turnover based on the association of portions of the stored chip count data with respective roulette games;

g. generate a report indicative of game turnover based on the value of chips used in each game cross-referenced with one or more other aspects of game data, the game data including any one or more of number of players per table, rate of game completion, game duration, and assigned chip value; and h. analyze said report to determine an optimal rate of game completion to maximize the game turnover.

2. Apparatus according to claim 1 wherein the one or more sensors are arranged to detect a ball in a rim of the roulette wheel, and to generate a signal corresponding to the start of a ball spin phase in response to that detection.

3. Apparatus according to claim 1 wherein the one or more sensors are arranged to detect a speed of a ball in a rim of the roulette wheel, and to generate a signal corresponding to the end of the betting phase when the speed of the ball falls below a predetermined speed.

4. Apparatus according to claim 1 wherein the one or more sensors are arranged to detect that a ball has entered a numbered pocket in the roulette wheel, and to generate a signal corresponding to the end of a ball spin phase in response to that detection.

5. Apparatus according to claim 4, wherein the signal corresponding to the end of the ball spin phase further includes data corresponding to the number of the numbered pocket.

6. Apparatus according to claim 1 wherein the one or more sensors are arranged to:

1. generate a signal corresponding to the start of the payout phase; and
2. generate a further signal corresponding to the end of the payout phase and the start of the betting phase of the next roulette game.

7. Apparatus according to claim 1 wherein the one or more sensors include an input device to provide signals responsive to predefined inputs from a table operator.

8. Apparatus according to claim 1 wherein the one or more sensors produce signals in response to the table operator interacting with a table component at times corresponding to specified game events.

9. Apparatus according to claim 1 wherein at least one of said one or more sensors comprises a camera connected to a machine vision system.

10. Apparatus according to claim 1, further comprising:

a dolly movable from a home position to a position on the roulette table layout at the start of the payout phase, and movable from the position on the roulette table layout to the home position at the end of the payout phase;

and wherein a detector is arranged to detect when the dolly is moved out of the home position and the signal corresponding to the start of the payout phase is generated in response to that detection; and the detector is arranged to detect when the dolly is placed in the home position and the further signal corresponding to the end of the payout phase is generated in response to that detection.

11. Apparatus according to claim 1 wherein the software instructions are executable to cause the at least one processor to process the data received from the one or more sensors to identify threshold periods of inactivity of the chipper machine.

12. Apparatus according to claim 1 wherein the software instructions are executable to cause the at least one processor to process data from two or more sensors to identify the game delineation events which define a betting phase, a ball spin phase, and a payout phase within a roulette game.

13. Apparatus according to claim 1, wherein the software instructions are executable to cause the at least one processor to analyze the timing information for the identified game delineation events, and to estimate a rate of game completion on the basis of that analysis.

14. Apparatus according to claim 1, wherein the software instructions are executable to cause the at least one processor to provide to a table operator data indicative of the estimated rate of game completion.

15. Apparatus according to claim 1, wherein the software instructions are executable to cause the at least one processor to provide to the operator data indicative of the estimated rate of game completion and a target rate of game completion.

16. Apparatus according to claim 1, wherein the software instructions are executable to cause the at least one processor to provide to the table operator a signal indicative of a suggestion to increase or decrease the rate of game completion.

17. Roulette apparatus, comprising:

a roulette wheel and a roulette table having a layout for placing of bets utilizing betting chips;

one or more sensors arranged to produce a plurality of signals in response to events during a roulette game indicating a plurality of different phases of the game delineated by said events;

a chipper machine that counts physical betting chips utilized at the roulette table and outputs betting chip count data;

a memory for storing data representing said identified game phases and their associated timing information; and at least one processor for executing instructions to cause the processor to:

a. receive said signals from the one or more sensors;

b. receive timing information for each of the said signals;

c. process said signals and said timing information thereby to identify said different game phases;

d. store the chip count data with associated timing information;

e. analyze the chip count data based on the timing information for the identified game delineation events, thereby to associate portions of the stored chip count data with respective roulette games;

f. estimate a game turnover based on the association of portions of the stored chip count data with respective roulette games;

g. generate a report indicative of game turnover based on the value of chips used in each game cross-referenced with one or more other aspects of game data h. generate a report indicative of game turnover based on the value of chips used in each game cross-referenced with one or more other aspects of game data which include any one or more of number of players per table; rate of game completion; game duration and assigned chip value; and i. analyze said reports to determine an optimal number of players per table to maximize the game turnover.

* * * * *